US011832771B2

(12) United States Patent
Li et al.

(10) Patent No.: US 11,832,771 B2
(45) Date of Patent: Dec. 5, 2023

(54) SELF-MECHANICAL-CLEANING TOILET SYSTEM WITH WATER-SPLASH CLEANING OPTIONS

(71) Applicants: Baozhong Li, Wappingers Falls, NY (US); Xiao Li, Frisco, TX (US)

(72) Inventors: Baozhong Li, Wappingers Falls, NY (US); Xiao Li, Frisco, TX (US)

( * ) Notice: Subject to any disclaimer, the term of this patent is extended or adjusted under 35 U.S.C. 154(b) by 186 days.

(21) Appl. No.: 17/673,771

(22) Filed: Feb. 16, 2022

(65) Prior Publication Data

US 2022/0257070 A1 Aug. 18, 2022

Related U.S. Application Data

(60) Provisional application No. 63/150,236, filed on Feb. 17, 2021.

(30) Foreign Application Priority Data

Apr. 19, 2021 (CN) ..... 202110421318.7

(51) Int. Cl.

| | |
|---|---|
| ***A47K 17/00*** | (2006.01) |
| ***A47K 11/02*** | (2006.01) |
| ***B08B 1/00*** | (2006.01) |
| ***B08B 3/02*** | (2006.01) |
| ***B08B 13/00*** | (2006.01) |

(52) U.S. Cl.

CPC ..... *A47K 17/00* (2013.01); *A47K 11/02* (2013.01); *B08B 1/005* (2013.01); *B08B 1/007* (2013.01); *B08B 1/008* (2013.01); *B08B 3/02* (2013.01); *B08B 13/00* (2013.01)

(58) Field of Classification Search

CPC ..... A47K 17/00; A47K 11/02; A47K 13/00; A47K 13/12; B08B 1/005; B08B 1/007; B08B 1/008; B08B 3/02; B08B 13/00; E03D 11/02; E03D 9/00; E03D 9/05; E03D 11/10; E03D 11/13

See application file for complete search history.

(56) References Cited

U.S. PATENT DOCUMENTS 3,921,228 A * 11/1975 Sundberg ..... A47K 11/023 4/111.5

4,545,295 A 10/1985 Russell (Continued)

*Primary Examiner* — Christine J Skubinna

(57) ABSTRACT

A self-mechanical-cleaning toilet system with water-splash cleaning options provides a more sanitary and comfortable bathroom experience with minimum water usage. The system includes a receiving trough, a removal scraper, a guide bar, a back door, a first translation mechanism, a second translation mechanism, and a controller. The receiving trough collects the excrement, while the removal scraper moves the excrement out. The guide bar controls the movement of the removal scraper along the receiving trough. The back door separates the receiving trough from an excrement storage compartment/sewer system. The first translation mechanism moves the removal scraper, while the second translation mechanism moves the back door as necessary. The controller monitors and controls the cycles of the operation of the first translation mechanism and the second translation mechanism. The water-splash cleaning options dispense specified amounts of fluids for cleaning and sanitation purposes. The system also includes means to eliminate unpleasant odors instantly.

20 Claims, 41 Drawing Sheets

(56) References Cited

U.S. PATENT DOCUMENTS

| | | | |
|---|---|---|---|
| 5,887,290 | A | 3/1999 | Nian |
| 6,070,522 | A | 6/2000 | Koljonen |
| 6,202,595 | B1 | 3/2001 | Atcravi |
| 6,851,386 | B2 | 2/2005 | Northrop |
| 9,364,124 | B2 | 6/2016 | Morris |
| 9,648,997 | B2 | 5/2017 | Shin-Ya |
| 10,638,894 | B2 | 5/2020 | Brunt |
| 2004/0010843 | A1 | 1/2004 | Erdmann |
| 2017/0007082 | A1 | 1/2017 | Li |

* cited by examiner

SELF-MECHANICAL-CLEANING TOILET SYSTEM WITH WATER-SPLASH CLEANING OPTIONS

The current application claims a priority to the U.S. provisional patent application Ser. No. 63/150,236 filed on Feb. 17, 2021.

FIELD OF THE INVENTION

The present invention relates generally to sanitation and plumbing systems. More specifically, the present invention includes an environmentally friendly toilet system with novel mechanical waste-removing and self-cleaning means as well as odor control.

BACKGROUND OF THE INVENTION

Currently, flush-less toilets, such as dry toilets, portable toilets, vault toilets, and/or pit latrine toilets with poor sanitation, are still popular and widely used in places without proper water supply, sewer system, and/or waste process facility. But they do not usually offer the sanitation and comfort levels needed. Most modern toilets are flushing toilets that provide great sanitation and comfort levels. However, they not only need huge amounts of fresh water because they use water as toxic gas barrier and depends on natural syphoning effect to take excrement to sewer pipes but also require a sewer system or huge septic tank to operate. Operation costs start to accumulate significantly when factoring in energy requirements involved in providing clean water, exhaust, and waste processing. In addition, odor control is always an issue for flushing toilets. Various other toilet systems have been designed in efforts to solve some of these problems, but they all suffer of similar shortcomings in trying to balance costs and user experience. So, the present invention provides a flush-less toilet solution that can meet pleasant and sanitary needs of the user while maintaining minimal water consumption.

An objective of the present invention is to provide an alternative sanitary solution to replace flush-less toilets with poor sanitation such as dry toilets, portable toilets, vault toilets, and/or pit latrine toilets by providing mechanical means to remove excrement. Another objective of the present invention is to provide a flush-less, self-cleaning toilet system with significantly improved sanitary levels and greater user experience. Another objective of the present invention is to provide a flush-less toilet system with sanitary levels compatible with flush toilets but only using very small amount of water or toilet detergent. Another objective of the present invention is to provide a substitute toilet system, with flushing option, in place a flushing toilet is current used, but requires much less water. Another objective of the present invention is to provide a toilet system with means to eliminate unpleasant smell from the surroundings.

SUMMARY OF THE INVENTION

The present invention is an odor-free and water-saving toilet system with mechanical self-clean and water-clean-combination options. The present invention is an alternative sanitary solution to replace poor sanitation flush-less toilets widely used in many developing countries. The present invention also provides a more user friendly and low-cost option for portable toilet with very small amount of water or detergent, which is ideal for construction site, large gatherings, environmentally fragile or water scarce area and place without sewer system as well as for RVs, boats, trains, and flights. When the largest amount water is selected, the present invention can be used as an efficient flushing toilet without activation of the mechanical clean features. In such case, the present invention is compatible with flushing toilets, but the present invention takes significantly less water to achieve same sanitary levels because it neither uses water as toxic gas barrier nor depends on natural syphoning effect to take excrement to sewer pipes as traditional flushing toilet does. The present invention utilizes mechanical means to remove the excrement without using great amounts of water or other chemicals to capture and neutralize the excrement and self-clean afterwards. The present invention utilizes minimal amounts of water for self-cleaning, greatly reducing water consumption as well as operation and maintenance costs. Further, the present invention can eliminate unpleasant excrement smell for the user to provide a more comfortable and sanitary experience.

In one embodiment, the present invention includes a tapered receiving trough with a removal scraper. The removal scraper is preferably an automatic mechanism that moves the excrement out of the receiving trough. The present invention utilizes a sliding back door which prevents toxic fumes from escaping through the receiving trough. The sliding back door also helps clean the removal scraper and utilizes the tapered receiving trough end edge to clean the sliding back door. Further, the back end opening of the receiving trough features very efficient ventilation means to eliminate toxic fumes, to vent waste smell away instantly from the bottom behind the user and to prevent odors escaping into the surroundings, with minimized amount of room temperature air vented to save energy. Furthermore, the present invention includes means for self-cleaning such as spray nozzles to help to improve the sanitation conditions. The present invention can be connected to existing sewer systems by a plumbing system in a residential or commercial facility. the open end of the tapered receiving trough may protrude outside bathroom and/or building so that the excrement can be disposed into removable waste receptacle or septic tank for decomposition outside directly to avoid handling the excrement inside bathroom or building. Alternatively, the present invention can include a removable waste receptacle to be used as a portable toilet. Additional features and benefits of the present invention are further discussed in the sections below.

DETAIL DESCRIPTIONS OF THE INVENTION

Figure 1:
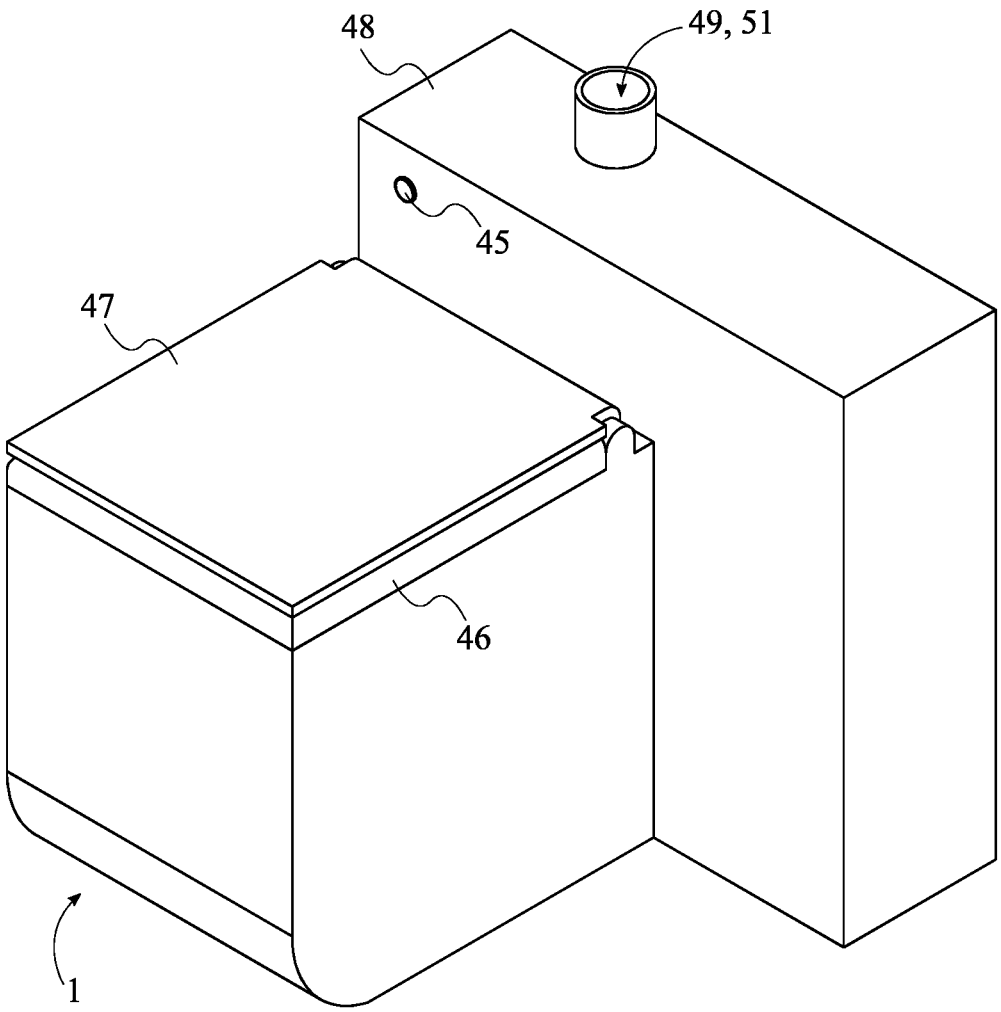
FIG. 1 is a top-front-left perspective view of the present invention.
Figure 2:
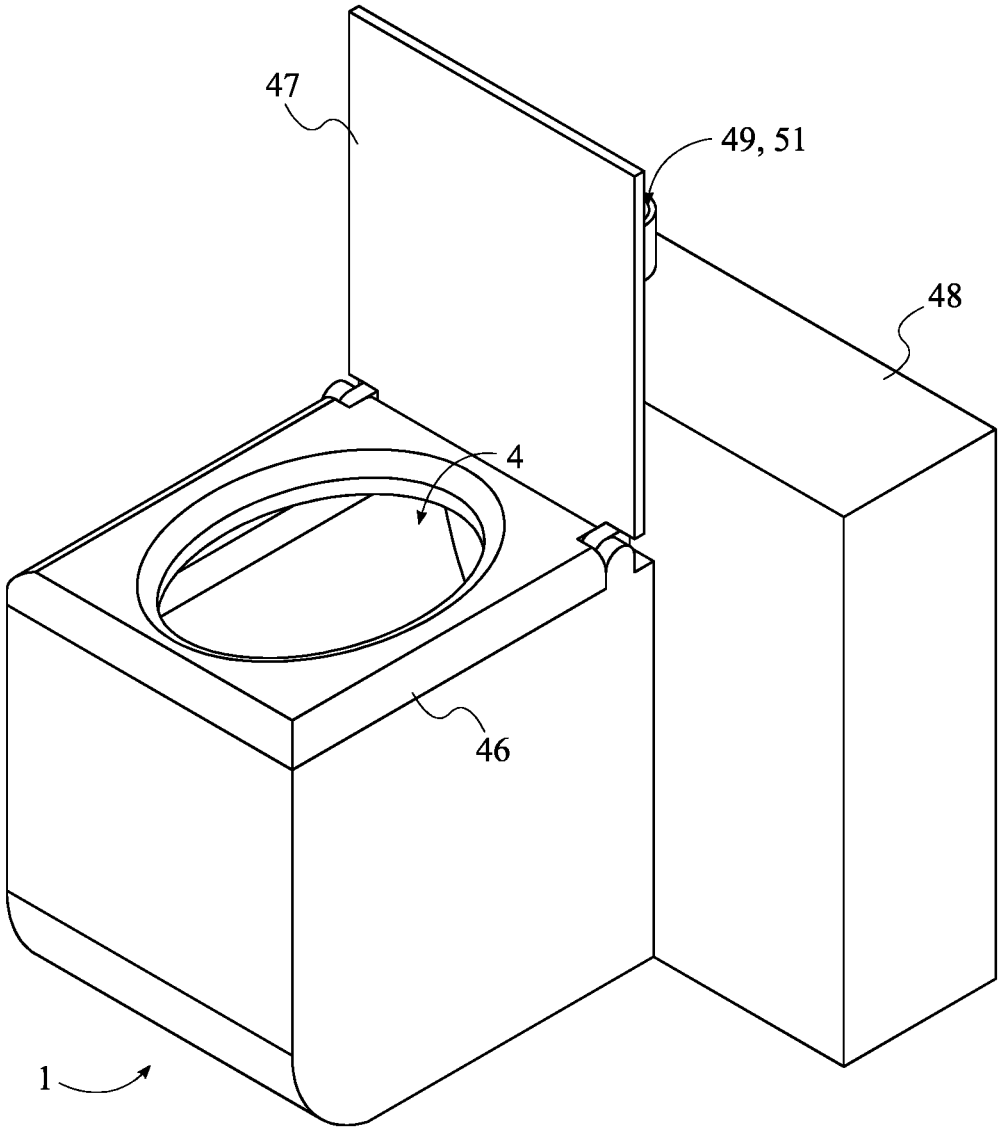
FIG. 2 is a top-front-right perspective view of the present invention, wherein the seat cover is shown opened.
Figure 3:
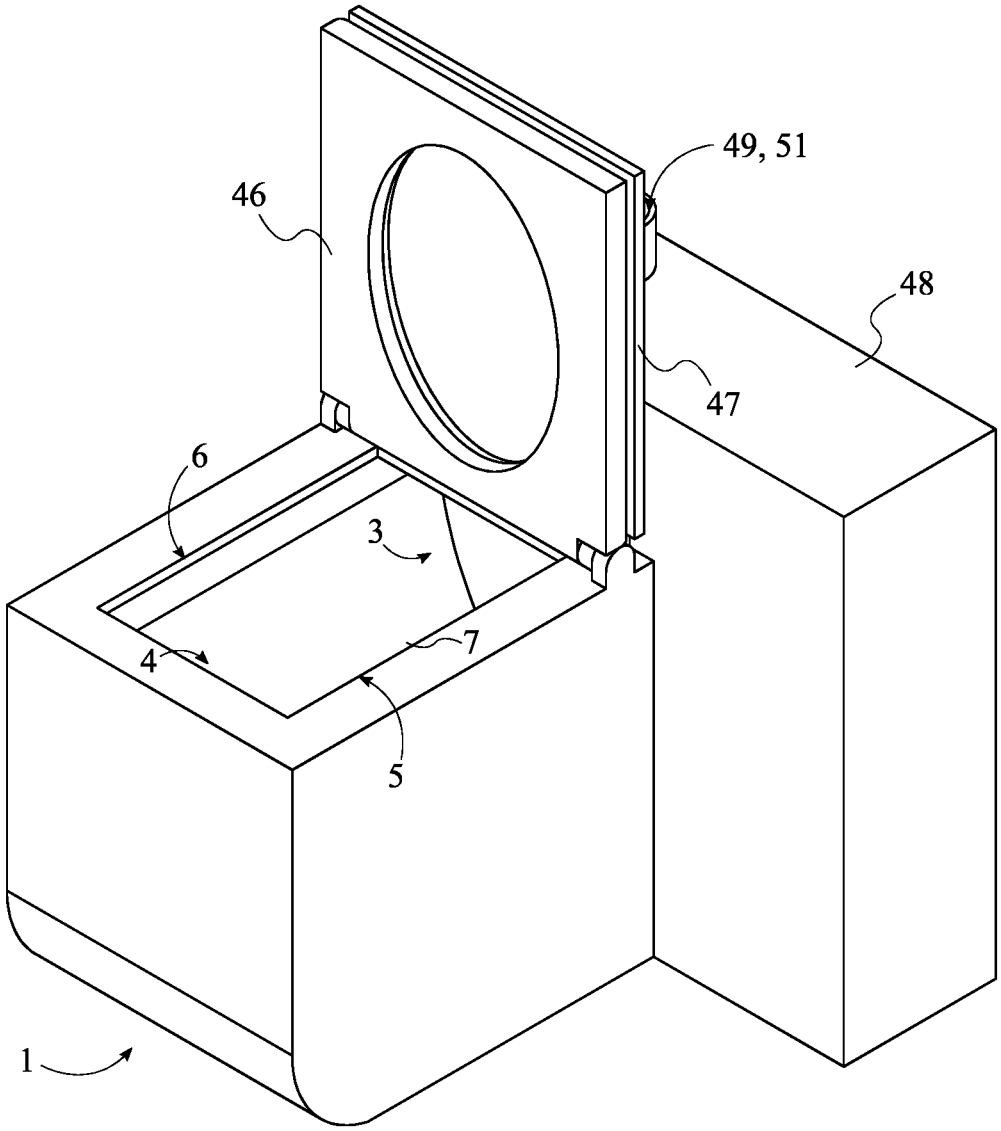
FIG. 3 is a top-front-right perspective view of the present invention, wherein the seat cover and the toilet seat are shown opened.
Figure 4:
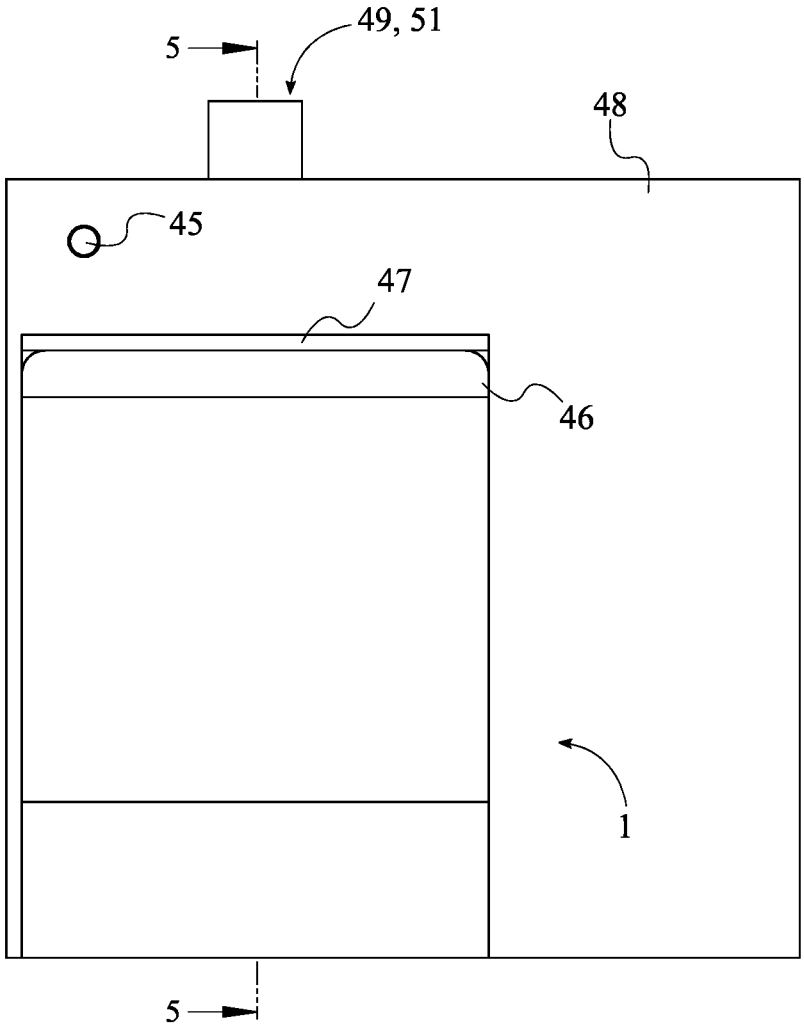
FIG. 4 is a front view of the present invention.
Figure 5:
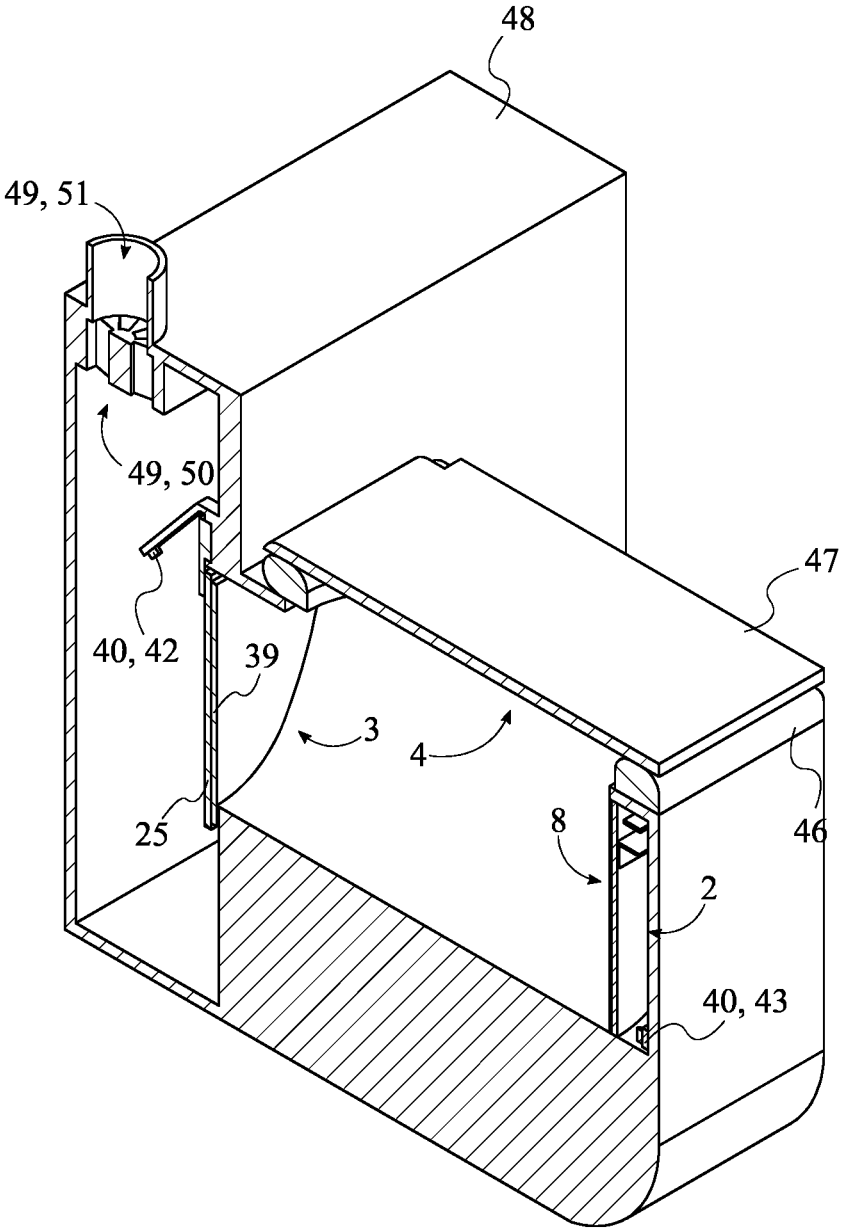
FIG. 5 is a cross-sectional perspective view taken along line 5-5 in FIG. 4.
Figure 6:
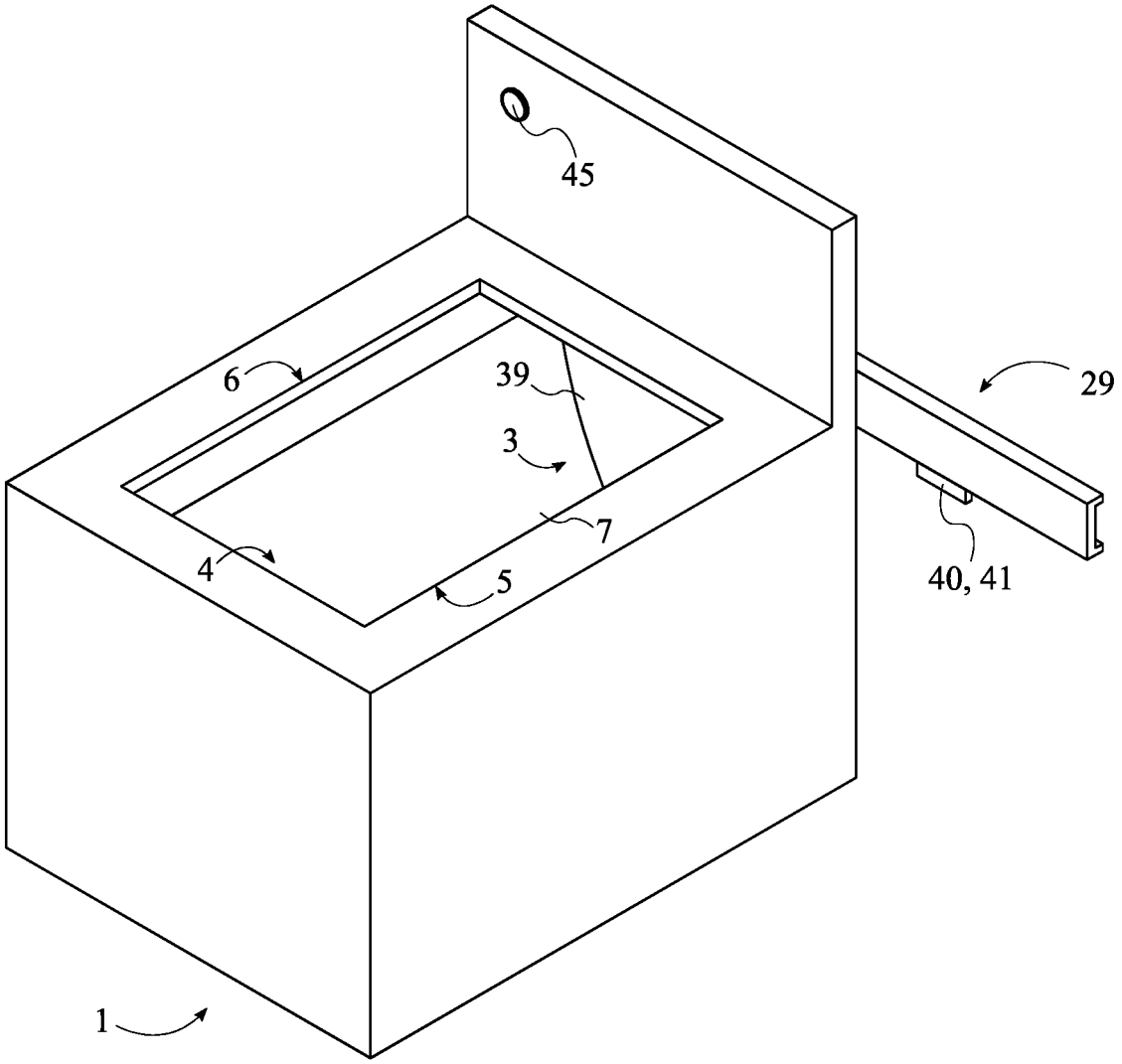
FIG. 6 is a top-front-left perspective view of the present invention, wherein the toilet seat, the seat cover, the waster enclosure, and the ventilation system are shown removed from the receiving trough, and wherein the removal scraper is shown at the starting position.
Figure 7:
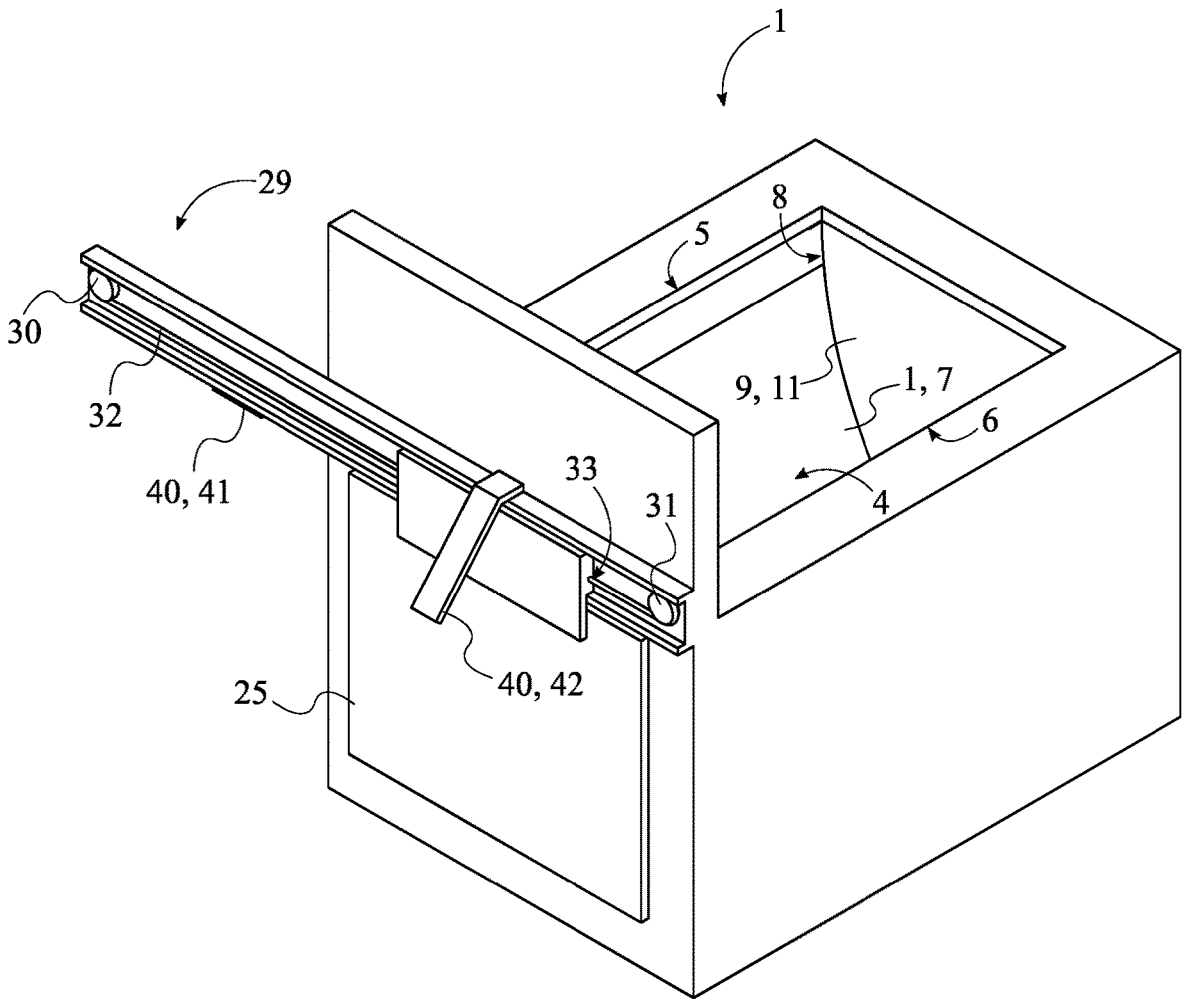
FIG. 7 is a top-rear-right perspective view thereof.
Figure 8:
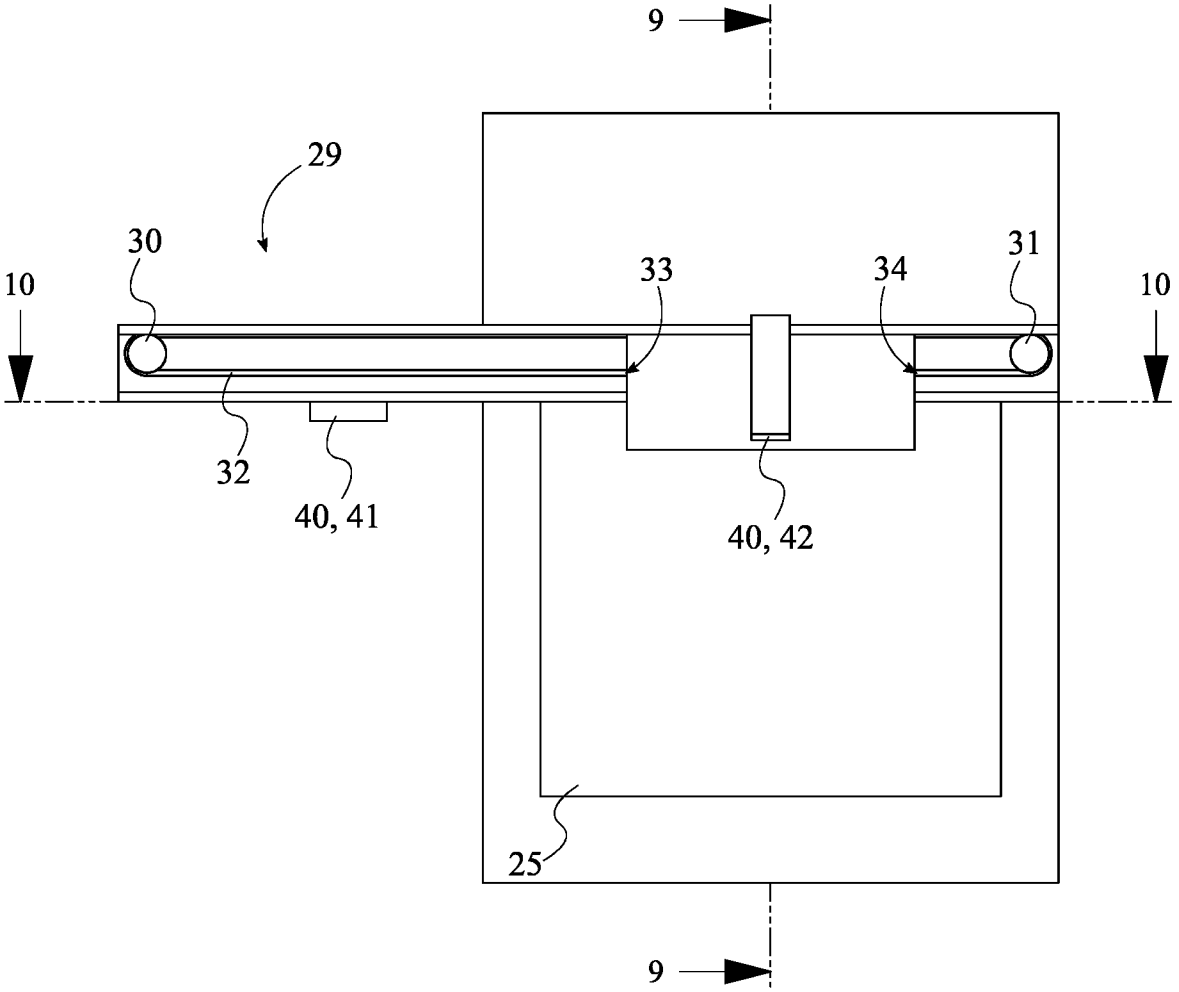
FIG. 8 is a rear view thereof.
Figure 9:
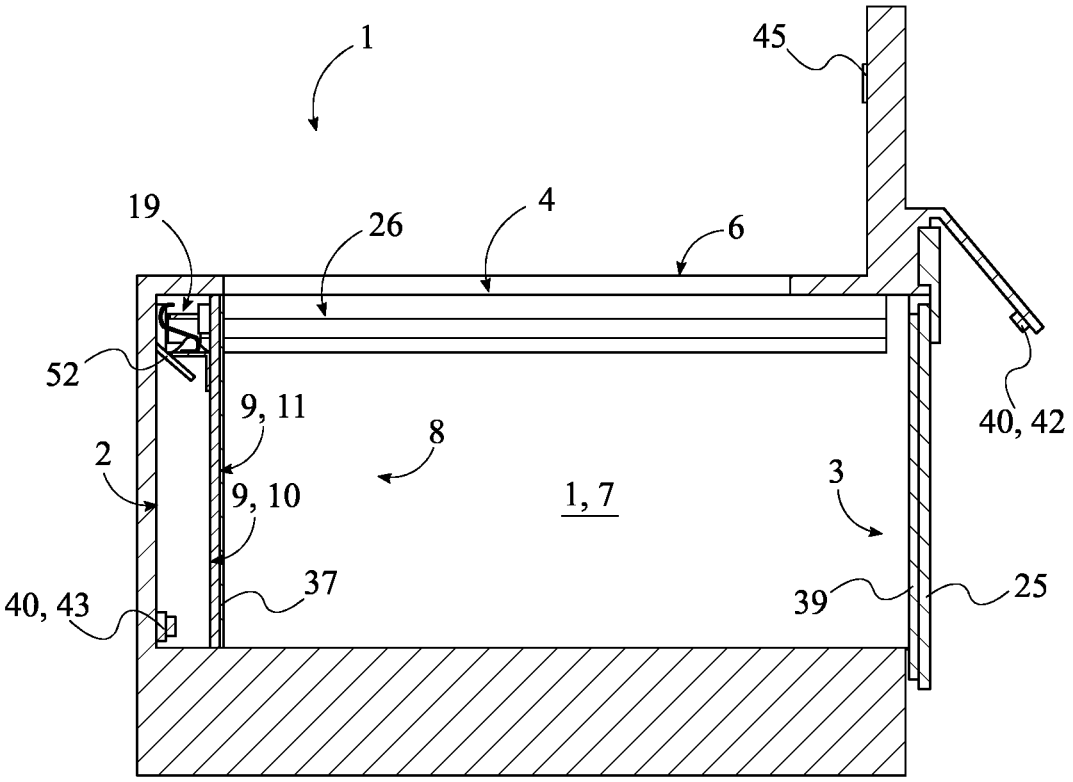
FIG. 9 is a vertical cross-sectional view taken along line 9-9 in FIG. 8.
Figure 10:
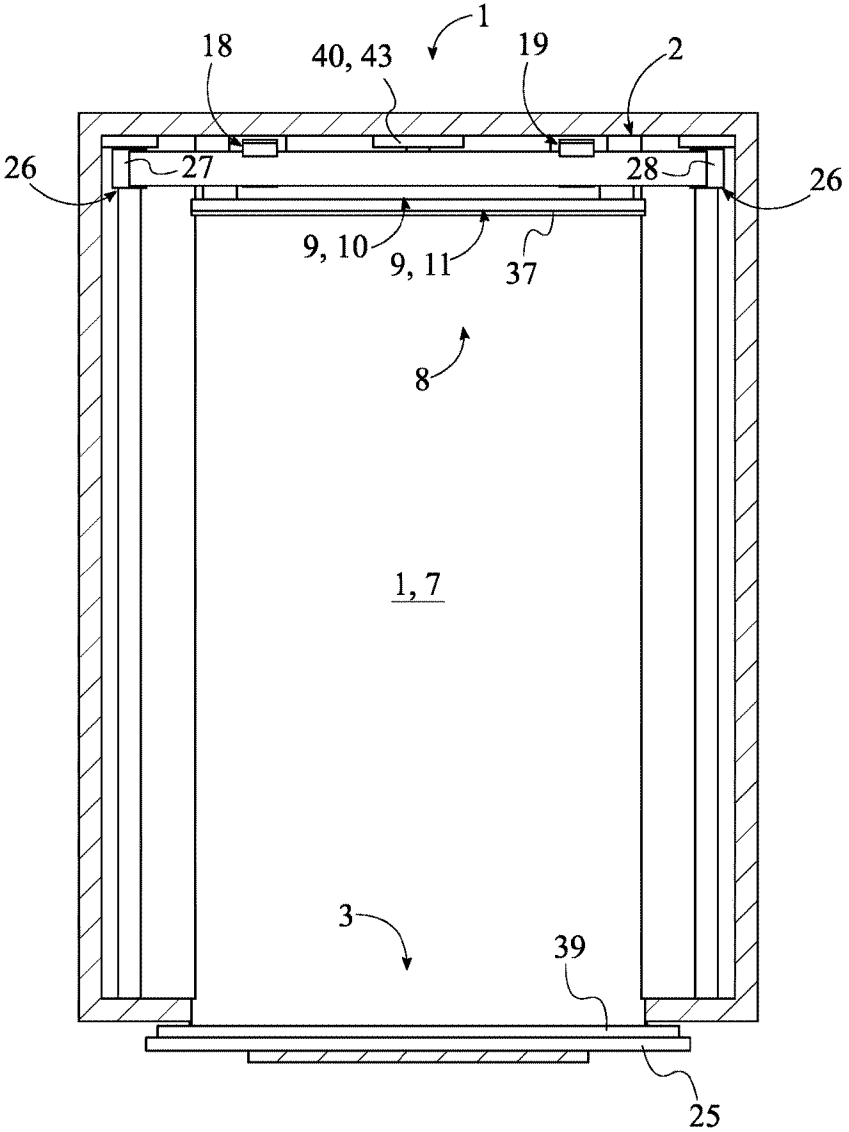
FIG. 10 is a horizontal cross-sectional view taken along line 10-10 in FIG. 8.

All illustrations of the drawings are for the purpose of describing selected versions of the present invention and are not intended to limit the scope of the present invention.

The present invention is an odor less self-mechanical-cleaning toilet system with water-splash cleaning options that provides a more sanitary and comfortable bathroom experience. As can be seen in FIGS. 1 through 10, the present invention preferably comprises a receiving trough 1, a removal scraper 8, a guide bar 24, a back door 25, a first translation mechanism 26, a second translation mechanism 29, and a controller 36. The receiving trough 1 temporarily collects the excrement before the excrement is disposed of. The removal scraper 8 moves the excrement out of the receiving trough 1 after use. The guide bar 24 controls the movement of the removal scraper 8 along the receiving trough 1. The back door 25 separates the receiving trough 1 from the excrement storage compartment or the sewer system/tank, prevents the toxic fumes escape from the sewer system/tank into user area, and also provides a path to vent the toxic fumes from the excrement collected within the receiving trough 1 instantly while using the present invention. The rear edge of the receiving trough 1 helps to clean the back door 25 and the back door 25 helps to clean the removal scraper 8 after moving the excrement out of the receiving trough 1. The first translation mechanism 26 enables the automatic operation of the removal scraper 8, while the second translation mechanism 29 enables the automatic operation of the back door 25. The programmable controller 36 combined with one or more sensors and a switch is used to monitor and control the starting time and cycles of each operation of the first translation mechanism 26 and the second translation mechanism 29.

The general configuration of the aforementioned components provides a flushless toilet option that is as sanitary as traditional toilets and more cost efficient. As can be seen in FIGS. 1 through 10, the receiving trough 1 is an elongated open channel with a slanted bottom that enables the quick disposal of the collected excrement. Accordingly, the receiving trough 1 comprises a closed end 2, an open end 3, a lateral opening 4, a first lengthwise edge 5, and a second lengthwise edge 6. The closed end 2 and the open end 3 correspond to the terminal ends of the receiving trough 1. The lateral opening 4 corresponds to the opening through which the excrement is deposited into the receiving trough 1. The first lengthwise edge 5 and the second lengthwise edge 6 correspond to the long edges adjacent to the lateral opening 4. To form the elongated receiving trough 1, the first lengthwise edge 5 and the second lengthwise edge 6 are positioned parallel and offset from each other. The lateral opening 4 is delineated by the first lengthwise edge 5, the second lengthwise edge 6, the closed end 2, and the open end 3. This way, the receiving trough 1 is designed to be a straight channel with a U-shaped cross-section. Further, the removal scraper 8 is slidably mounted into the receiving trough 1 through the lateral opening 4 so that the removal scraper 8 can move the excrement collected within out of the receiving trough 1.

As can be seen in FIGS. 10, 15, 20, 25, 30, and 35, the guide bar 24 is positioned perpendicular and across the lateral opening 4 so that the guide bar 24 travels along the length of the receiving trough 1. The guide bar 24 is also operatively coupled to the receiving trough 1 by the first translation mechanism 26, wherein the first translation mechanism 26 is used to move the guide bar 24 along the receiving trough 1. For example, the first translation mechanism 26 is a motorized mechanism that converts rotational motion to linear motion to move the guide bar 24 along the receiving trough 1. In addition, the guide bar 24 is operatively coupled to the removal scraper 8, wherein the guide bar 24 is used to push and pull the removal scraper 8 along the receiving trough 1. This way, as the guide bar 24 is translated along the receiving trough 1 by the first translation mechanism 26, the guide bar 24 pushes or pulls the removal scraper 8. This allows the removal scraper 8 to move the collected excrement out of the receiving trough 1 through the open end 3. Further, the back door 25 is slidably mounted across the open end 3 and the second translation mechanism 29 is operatively mounted to the back door 25 and the open end 3 to automate the operation of the back door 25. The second translation mechanism 29 is used to move the back door 25 across the open end 3 and is used to retract the back door 25 from the open end 3. For example, the back door 25 is opened by the second translation mechanism 29 to allow the collected excrement to be moved out of the receiving trough 1 using the removal scraper 8. Once the collected excrement has been removed, the back door 25 is closed by the second translation mechanism 29. While closing the open end 3, the back door 25 also cleans the removal scraper 8, as well as the open end 3. When the back door 25 is opened by the second translation mechanism 29, the open end 3 helps to remove any excrement on the back door 25 in case there is any. Further, the closed back door 25 keeps the sewer system or excrement storage compartment where the collected excrement is disposed into isolated from the receiving trough 1 and user area. Furthermore, the controller 36 is electronically connected to the first translation mechanism 26 and the second translation mechanism 29 so that the first translation mechanism 26 and the second translation mechanism 29 can be configured to operate automatically.

As previously discussed, the removal scraper 8 is designed to mechanically remove the collected excrement within the receiving trough 1. To do so, the removal scraper 8 may comprise a scraper plate 9, a scraper bracket 13, a first pin 14, and a second pin 15. As can be seen in FIGS. 36 through 39, the scraper plate 9 is preferably a thin structure made from antimicrobial material that does not oxidize easily. The scraper plate 9 comprises a forward face 10 and a rearward face 11 corresponding to the opposite flat surfaces of the scraper plate 9. The forward face 10 is preferably oriented towards the closed end 2, while the rearward face 11 is oriented towards the open end 3. In addition, the scraper plate 9 may be coated for greater sanitation purposes. The present invention may further comprise a hydrophobic coating 37 that is superimposed across the rearward face 11. This way, as the scraper plate 9 moves the excrement out of the receiving trough 1, the excrement can more easily slide off the scraper plate 9. To enable the translation of the scraper plate 9 along the receiving trough 1, the scraper bracket 13 is connected onto the forward face 10. In addition, the first pin 14 is slidably and rotatably connected along the first lengthwise edge 5. Likewise, the second pin 15 is slidably and rotatably connected along the second lengthwise edge 6. Further, the scraper bracket 13 being connected in between the first pin 14 and the second pin 15. This way, the scraper plate 9 hangs from the first pin 14 and the second pin 15 by the scraper bracket 13 while enabling the translation of the scraper plate 9 along the first lengthwise edge 5 and the second lengthwise edge 6. In addition, this enables the scraper plate 9 to pivot about the first pin 14 and the second pin 15 up or down depend on the moving direction. Furthermore, the guide bar 24 is operatively coupled in between the scraper plate 9 and the scraper bracket 13, wherein the guide bar 24 is used to slide the scraper plate 9 towards the open end 3 and slide the scraper plate 9 towards the closed end 2. For example, the guide bar 24 is arranged to push and pull the scraper plate 9 by pulling and pushing on the scraper plate 9.

As can be seen in FIGS. 36 through 39, to facilitate the pushing of the scraper plate 9 by the guide bar 24, the removal scraper 8 further comprises a first bumper 16 and a second bumper 17 to ensure that the guide bar 24 has efficient contact with the scraper plate 9. To do so, the first bumper 16 and the second bumper 17 are peripherally connected onto the forward face 10. The first bumper 16 and the second bumper 17 are positioned offset from the scraper bracket 13 so that when the guide bar 24 pushes the scraper plate 9, the scraper plate 9 moves perpendicular to the guide bar 24. The first bumper 16 and the second bumper 17 are also positioned offset to each other to ensure that the scraper plate 9 moves parallel to the guide bar 24. Thus, as can be seen in FIGS. 11 through 20, when the guide bar 24, the first bumper 16, and the second bumper 17 are arranged into a waste removal configuration, the guide bar 24 is positioned against the first bumper 16 and the second bumper 17, moving the scraper plate 9 towards the open end 3 as well as the excrement being moved by the scraper plate 9.

As can be seen in FIGS. 1 through 10 and 36 through 39, to ensure that all the collected excrement is removed from the receiving trough 1, the scraper plate 9 is designed to match the cross-sectional shape of the receiving trough 1. To do so, the scraper plate 9 comprises a convex edge 12 while the receiving trough 1 comprises a concave surface 7. Further, the convex edge 12 is coextensive with the concave surface 7. This way, when the scraper plate 9 is being pushed towards the open end 3, the scraper plate 9 covers the whole inner space of the receiving trough 1 to move all the collected excrement. To further ensure that all the collected excrement is removed, the present invention may further comprise a rubber lining 38 which facilitates the removal of small excrement matter that may be adhered to the concave surface 7. To do so, the rubber lining 38 is connected along the convex edge 12 so that the rubber lining 38 is in contact with the whole concave surface 7.

After the collected excrement has been pushed out of the receiving trough 1 via the open end 3, the re-positioned back door 25 helps to clean the scraper plate 9. Then, the scraper plate 9 is pulled back to the starter position by the guide bar 24. As can be seen in FIGS. 26 through 30 and 36 through 39, to facilitate the pulling of the scraper plate 9 by the guide bar 24, the removal scraper 8 may further comprise a first catcher 18 and a second catcher 19. The first catcher 18 and the second catcher 19 help the guide bar 24 pull on the scraper plate 9 without the scraper plate 9 dragging on either side. To do so, the first catcher 18 and the second catcher 19 each comprises a springboard 20 and a hook 23. The springboard 20 helps ensure that guide bar 24 engages with the hook 23 in such a way that when the guide bar 24 engages with the hook 23, it depresses the springboard 20 to make the scraper plate 9 pivot upwards about the first pin 14 and the second pin 15. This way, the bottom side of the scraper plate 9 is raised up while being pulled back towards the closed end 2, so the scraper plate 9 does not drag on the concave surface 7. The springboard 20 is preferably an elongated thin structure that is flexible enough to enable the hook 23 to move up and down as the guide bar 24 engages with the hook 23. Due to the elongated structure of the springboard 20, the springboard 20 comprises a first board end 21 and a second board end 22. Further, the first catcher 18 and the second catcher 19 are positioned adjacent to the scraper bracket 13, opposite the scraper plate 9. The first catcher 18 and the second catcher 19 are also positioned offset from each other. This way, when the guide bar 24 engages with the hook 23 on each catcher, the scraper plate 9 is pulled evenly. Furthermore, the first board end 21 of the first catcher 18 and the first board end 21 of the second catcher 19 are connected onto the scraper bracket 13, while the hook 23 is connected onto the second board end 22. The springboard 20 is also oriented away from the receiving trough 1. Thus, when the guide bar 24, the first catcher 18, and the second catcher 19 are arranged into a retraction configuration, the guide bar 24 is positioned against the hook 23 of the first catcher 18 and the hook 23 of the second catcher 19. At the same time, the guide bar 24 pushes down the scraper bracket 13 through the springboard 20, which forces the scraper plate 9 to pivot upwards. However, as the springboard 20 approaches towards the closed end 2, the first board end 21 touches the top wall edge (or the corresponding scrapper stopper 52) of the closed end 2 first, then moving further results in the scrapper stopper 52 produce an upward force on the first board end 21. The scraper stopper 52 is one or more protrusions located adjacent to the closed end 2 designed to enable the repositioning of the removal scraper 8 so that the removal scraper 8 is ready for use. When the upward force counterbalances the downward forces applied on the hook 23 by the guide bar 24, then the scraper plate 9 is pivoted down and finally the rubber lining 38 along the convex edge 12 of the scraper plate 9 is in close contact with the whole concave surface 7 when the guide bar 24, together with the scraper plate 9, reach the starting point nearby the closed end 2. In other embodiments, other means can be utilized to pull or push and lift up or put down the scraper plate 9.

As previously disclosed, the first translation mechanism 26 is configured to automatically move the removal scraper 8 along the receiving trough 1. As can be seen in FIGS. 10 through 35, to do so, the first translation mechanism 26 may comprise a first motorized carriage 27 and a second motorized carriage 28. Both the first motorized carriage 27 and the second motorized carriage 28 enable the automatic translation of the removal scraper 8 without the user having to touch the present invention. The first motorized carriage 27 is movably mounted along the first elongated guide, while the second motorized carriage 28 is movably mounted along the second elongated guide. This way, the removal scraper 8 is pushed/pulled on both sides to prevent the removal scraper 8 from dragging on either side. The first motorized carriage 27 is terminally connected to the guide bar 24, while the second motorized carriage 28 is terminally connected to the guide bar 24, opposite to the first motorized carriage 27. Thus, the guide bar 24 is equally pushed/pulled on by the first motorized carriage 27 and the second motorized carriage 28. In some embodiments, both the first motorized carriage 27 and the second motorized carriage 28 can be a worm drive that includes at least a spindle and a motor. The spindle is rotatably connected to the motor so that the rotational motion of the motor is converted to linear motion. In an exemplary embodiment, the spindle can have male threading while the corresponding motorized carriage has female threading. So, while the motor rotates the spindle, the motorized carriage is moved in the desired linear direction. In other embodiments, other motorized means can be utilized to automatically translate the removal scraper 8 to move the collected excrement out of the receiving trough 1.

Similar to the removal scraper 8, the back door 25 is preferably designed to be automatically moved to open and close the open end 3 to separate the plumbing system or waste storage compartment from the receiving trough 1 and user area. As can be seen in FIGS. 10 through 35, to do so, the second translation mechanism 29 may comprise a first pulley 30, a second pulley 31, and a translation cable 32. The first pulley 30 and the second pulley 31 are arranged to pull the back door 25 sideways to open and close the open end 3 by pulling on the translation cable 32. The translation cable 32 comprises a first cable end 33 and a second cable end 34 corresponding to the terminal ends of the translation cable 32. Further, the first pulley 30 is preferably a motorized pulley 35 that can be automatically engaged. To pull the back door 25 sideways, the first pulley 30 is positioned offset from the back door 25, while the second pulley 31 is positioned offset from the back door 25, opposite the first pulley 30. Further, the first pulley 30 and the second pulley 31 are rotatably mounted to the open end 3 so that both can pull on the translation cable 32. So, the translation cable 32 is frictionally engaged about the first pulley 30 and about the second pulley 31. In addition, the first cable end 33 is connected adjacent to the backdoor, while the second cable end 34 is connected adjacent to the backdoor, opposite to the first cable end 33. This arrangement enables the back door 25 to be slid from a first position where the back door 25 seals the open end 3 to a second position where the back door 25 is offset from the open end 3, and vice versa. For example, when the open end 3 needs to be exposed, the first pulley 30 is engaged to rotate clockwise, which pulls on the translation cable 32, which then rotates the second pulley 31. In turn, the second pulley 31 pulls on the second cable end 34, which pulls the back door 25 towards the second pulley 31. On the other hand, when the open end 3 needs to be sealed, the first pulley 30 is engaged to rotated counterclockwise, which pulls on the first cable end 33 that pulls the back door 25 towards the open end 3 until the back door 25 seals the open end 3. In other embodiments, the second pulley 31 can also be a motorized pulley 35 to lessen the load on the first pulley 30.

As previously mentioned, the back door 25 not only serves to seal the open end 3, but also helps maintain the removal scraper 8 clean. The back door 25 also is kept clean automatically due to the back door 25 being pressed against the open end 3 by the second translation mechanism 29 when opening and sealing the open end 3. As can be seen in FIGS. 15 through 25, to do so, the present invention may further comprise a scrubber 39. The scrubber 39 can be a rubber or sponge material that physically removes any excrement residue on the removal scraper 8 after the removal scraper 8 moves the collected excrement out of the receiving trough 1 through the open end 3. The scrubber 39 is positioned in between the back door 25 and the open end 3 so that the scrubber 39 is in contact with the removal scraper 8 when the back door 25 is moved sideways by the second translation mechanism 29 and the removal scraper 8 is positioned adjacent to the open end 3 by the first translation mechanism 26. In addition, the scrubber 39 is connected across the back door 25. This way, as the back door 25 is moved to seal the open end 3, the scrubber 39 is pressed against the rearward face 11, removing any excrement residue on the removal scraper 8 before the removal scraper 8 is moved to the starter position. Furthermore, since the scrubber 39 is in contact with the open end 3 when the back door 25 is moved sideways by the second translation mechanism 29, the open end 3 helps to physically remove any excrement residue on the back door 25 and/or the scrubber 39. In some embodiments, this is due to the concave surface 7 protruding past the open end 3, which results in an edge that scrapes off any residue from the scrubber 39 and/or the back door 25.

In some embodiments, the present invention may include means to spray fluids to help make the present invention meet desired sanitary levels. As can be seen in FIGS. 6 through 35, 40, and 41, to do so, the present invention may further comprise a plurality of spray nozzles 40. The plurality of spray nozzles 40 is configured to dispense specified amount of fluid to help clean and/or sanitize the present invention. The present invention may further comprise a water inlet 44 which is connected to a water source such as the water utilities of the building or a water/detergent reservoir in case the present invention is designed as a portable toilet or in place water supply is not available, or vehicles like RV, train, ships, and flights. To dispense the fluid, the water inlet 44 is in fluid communication with each of the plurality of spray nozzles 40. The plurality of spray nozzles 40 is operatively mounted to the receiving trough 1, wherein the plurality of spray nozzles 40 is used to dispense water onto the back door 25 and the concave surface 7 of the receiving trough 1. For example, the plurality of spray nozzles 40 can be positioned to dispense small quantities of fluid on the concave surface 7, the rearward face 11, the scrubber 39, or any other surfaces that are exposed to excrement and where bacteria can grow. Further, the controller 36 is electronically connected to the plurality of spray nozzles 40 so that the operation of the plurality of spray nozzles 40 can be configured to be automatically performed as programmed.

Figure 11:
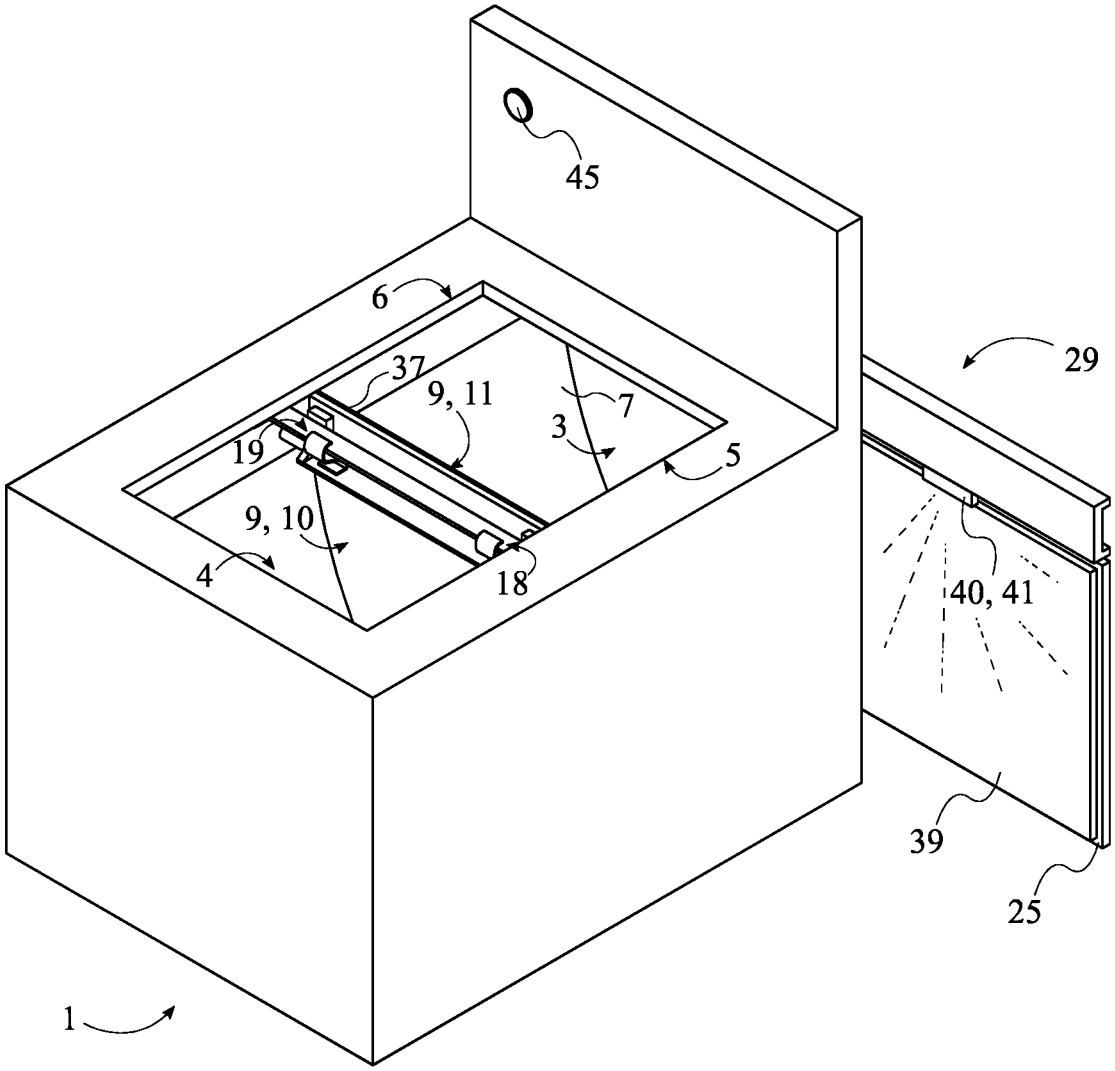
FIG. 11 is a top-front-left perspective view thereof, wherein the removal scraper is shown being moved towards the open end by the first translation mechanism, and wherein the back door is shown being moved away from the open end by the second translation mechanism.
Figure 12:
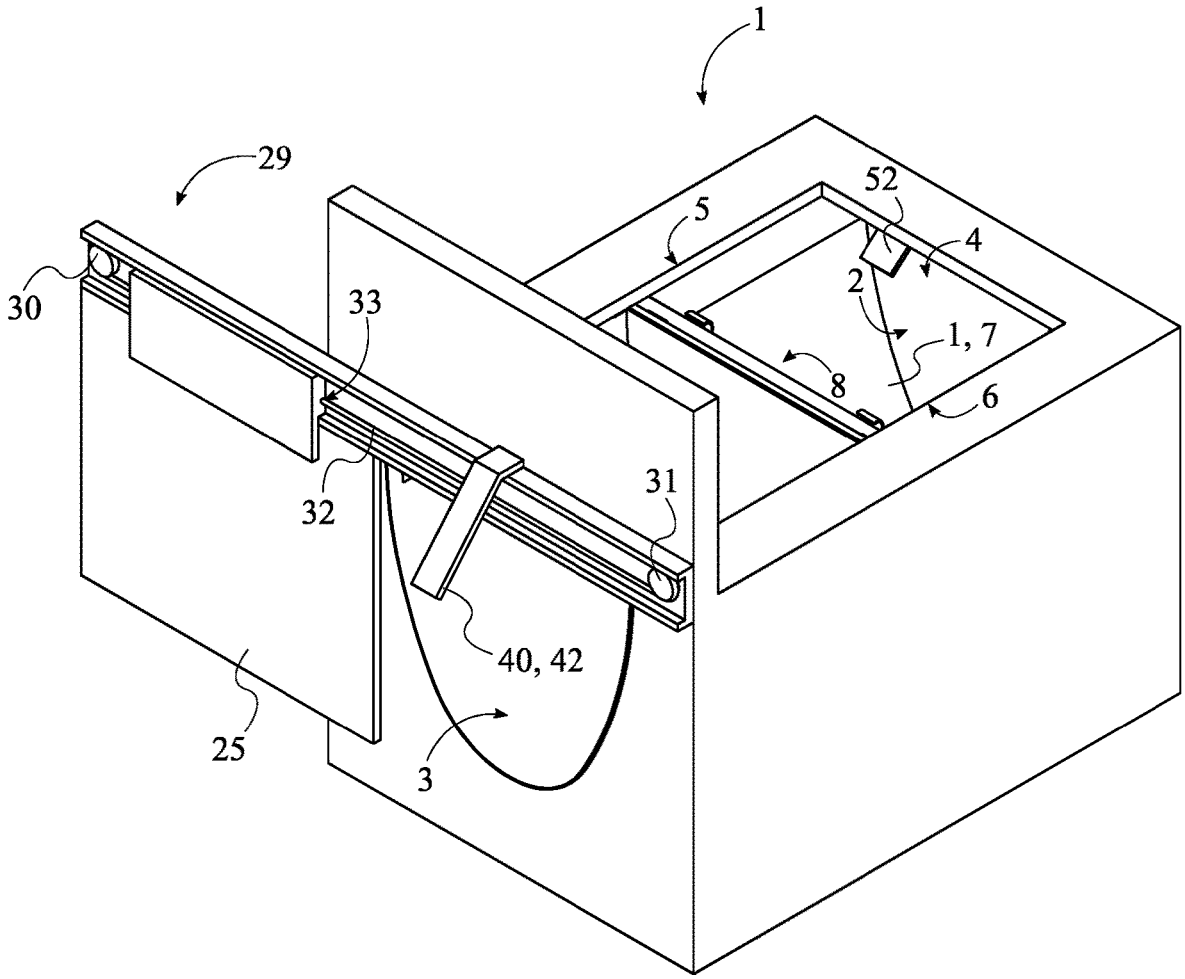
FIG. 12 is a top-rear-right perspective view thereof.
Figure 13:
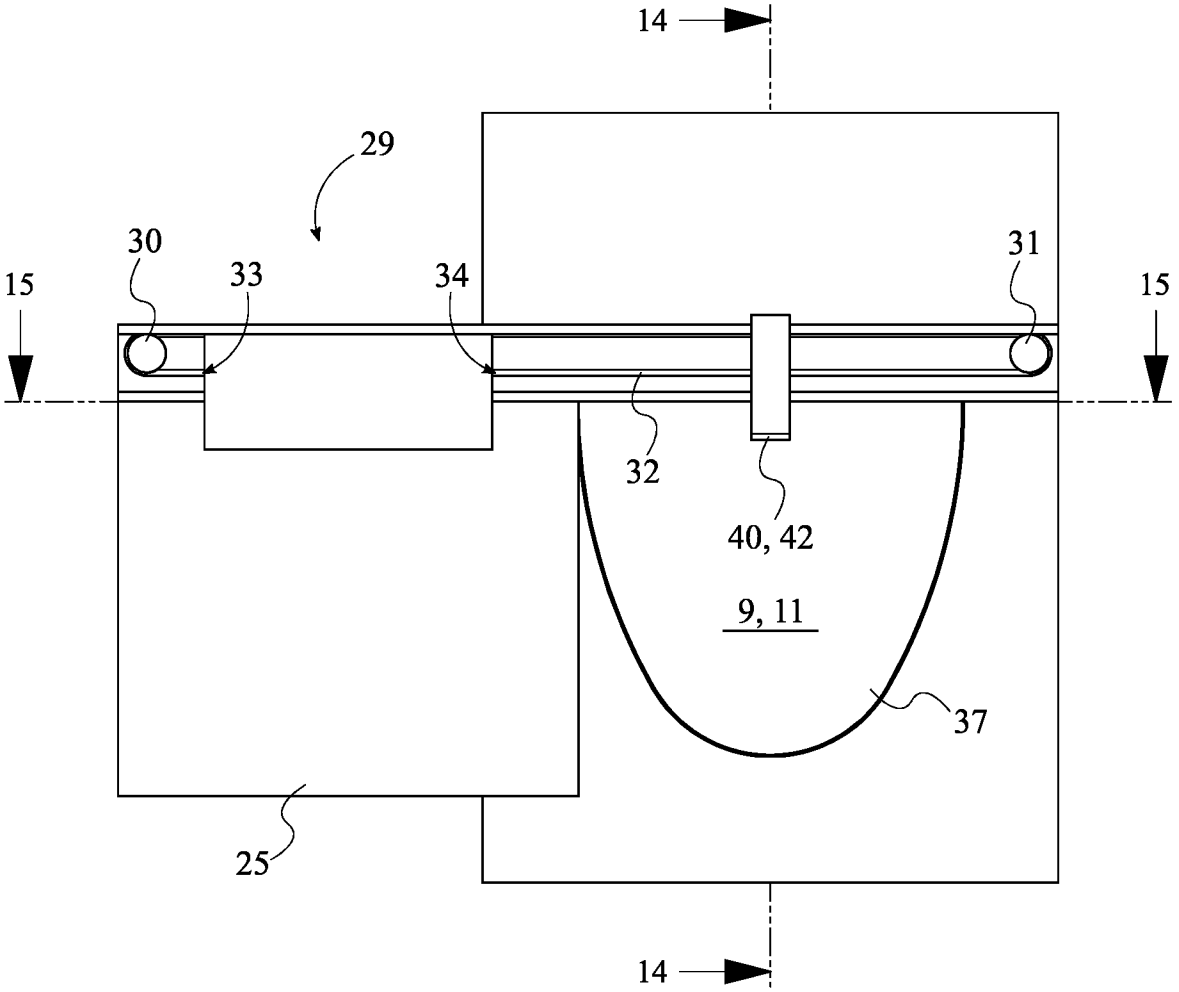
FIG. 13 is a rear view thereof.
Figure 14:
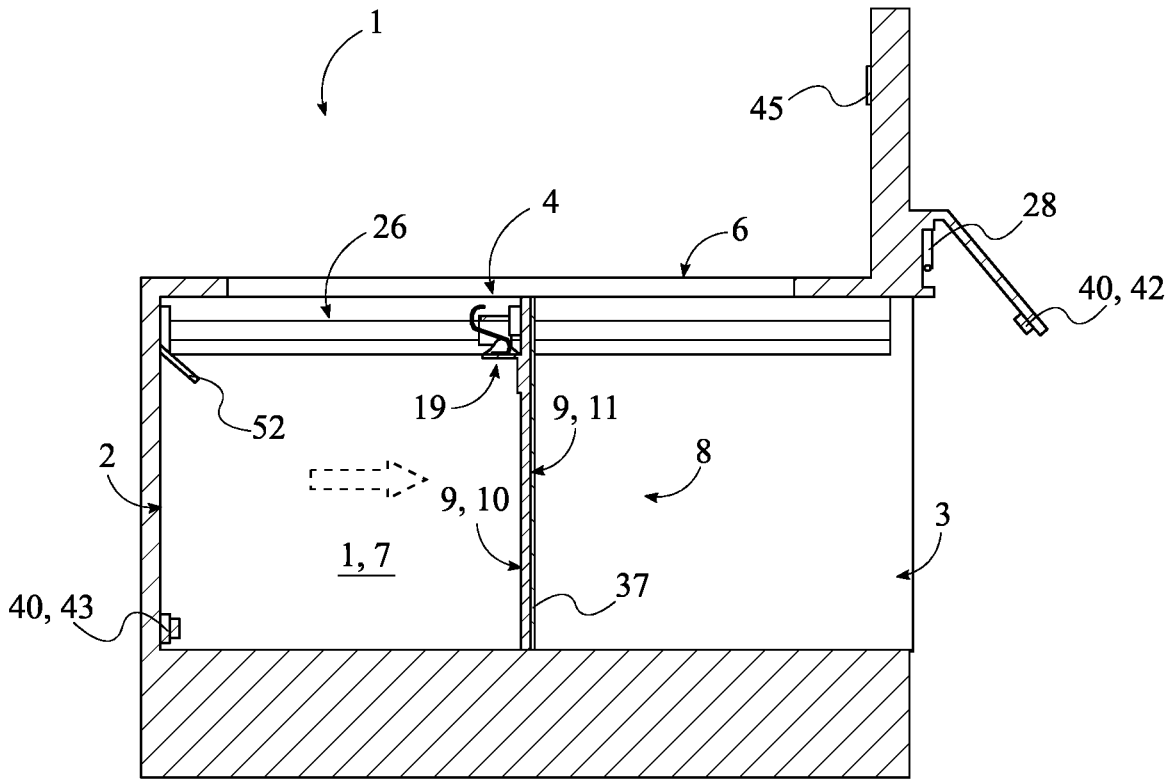
FIG. 14 is a vertical cross-sectional view taken along line 14-14 in FIG. 13.
Figure 15:
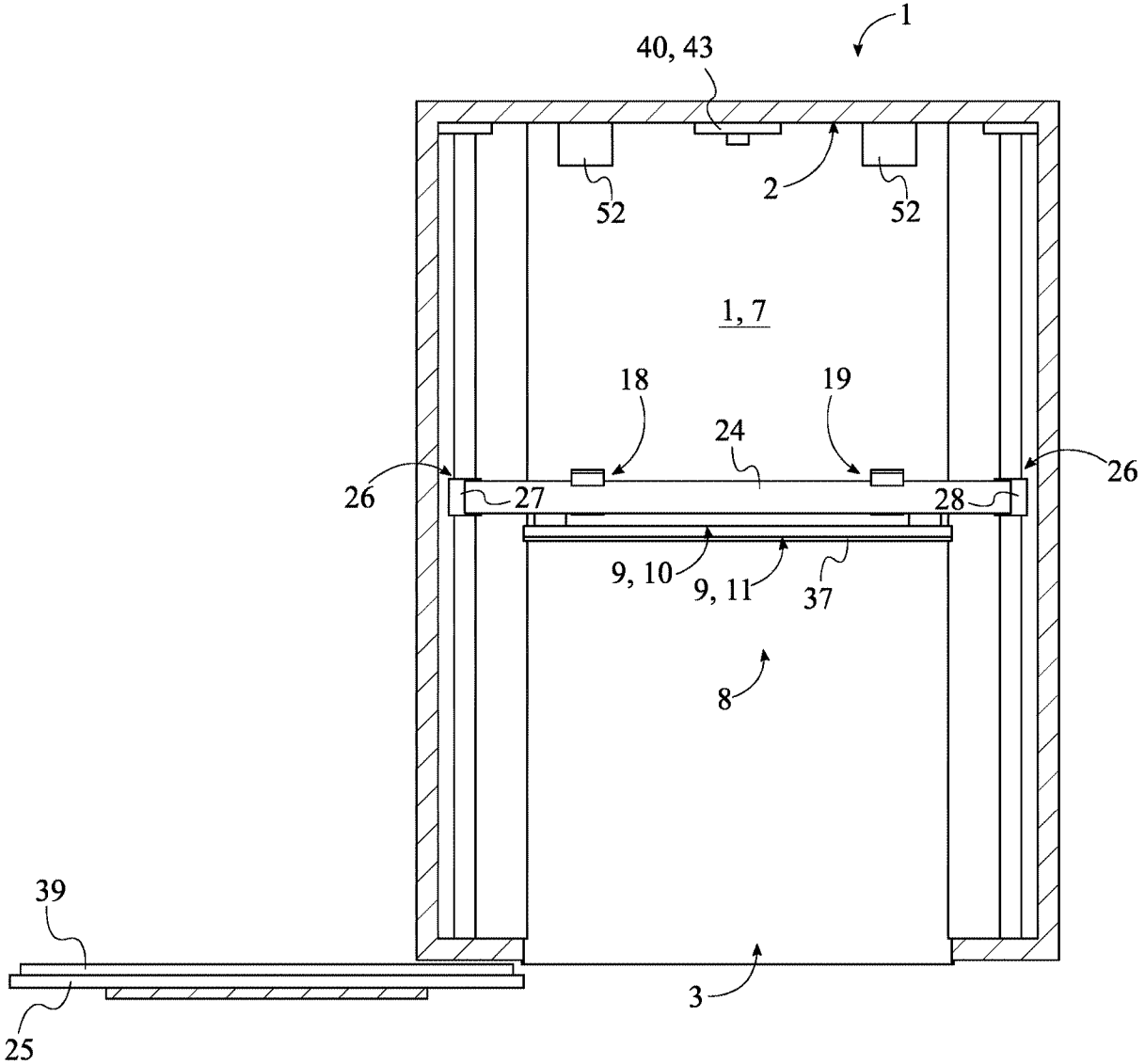
FIG. 15 is a horizontal cross-sectional view taken along line 15-15 in FIG. 13.
Figure 16:
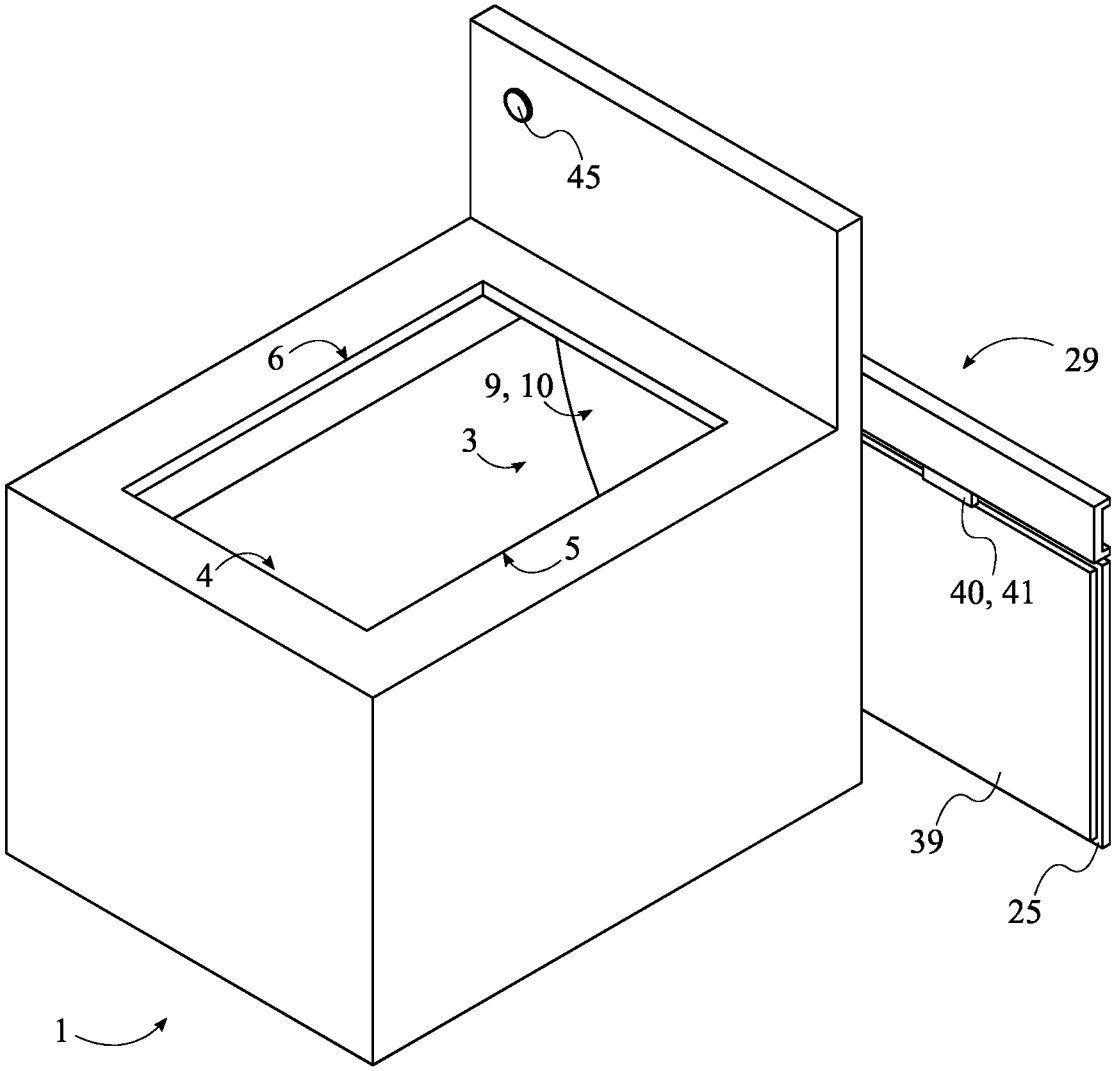
FIG. 16 is a top-front-left perspective view thereof, wherein the removal scraper is shown positioned at the open end.

To ensure that the plurality of spray nozzles 40 is positioned on the places where sanitation is necessary, the plurality of spray nozzles 40 may comprise at least one first spray nozzle 41. As can be seen in FIGS. 11, at least one first spray nozzle 41 is preferably configured to spray fluids onto the scrubber 39 so that the scrubber 39 is wet and clean when the scrubber 39 is pushed against the rearward face 11 to further clean the rearward face 11 and/or when the back door 25 is moved back to close position to seal the open end 3 of the receiving trough 1. To do so, the at least one first spray nozzle 41 is laterally positioned to the receiving trough 1 on the position where the back door 25 is moved aside from the open end 3. The at least one first spray nozzle 41 is also mounted adjacent to the open end 3 so that the at least one first spray is adjacent to the scrubber 39. Furthermore, the at least one first spray nozzle 41 is oriented away from the closed end 2 so that when fluids are sprayed by the at least one first spray nozzle 41, the fluids are dispensed onto the scrubber 39.

Figure 17:
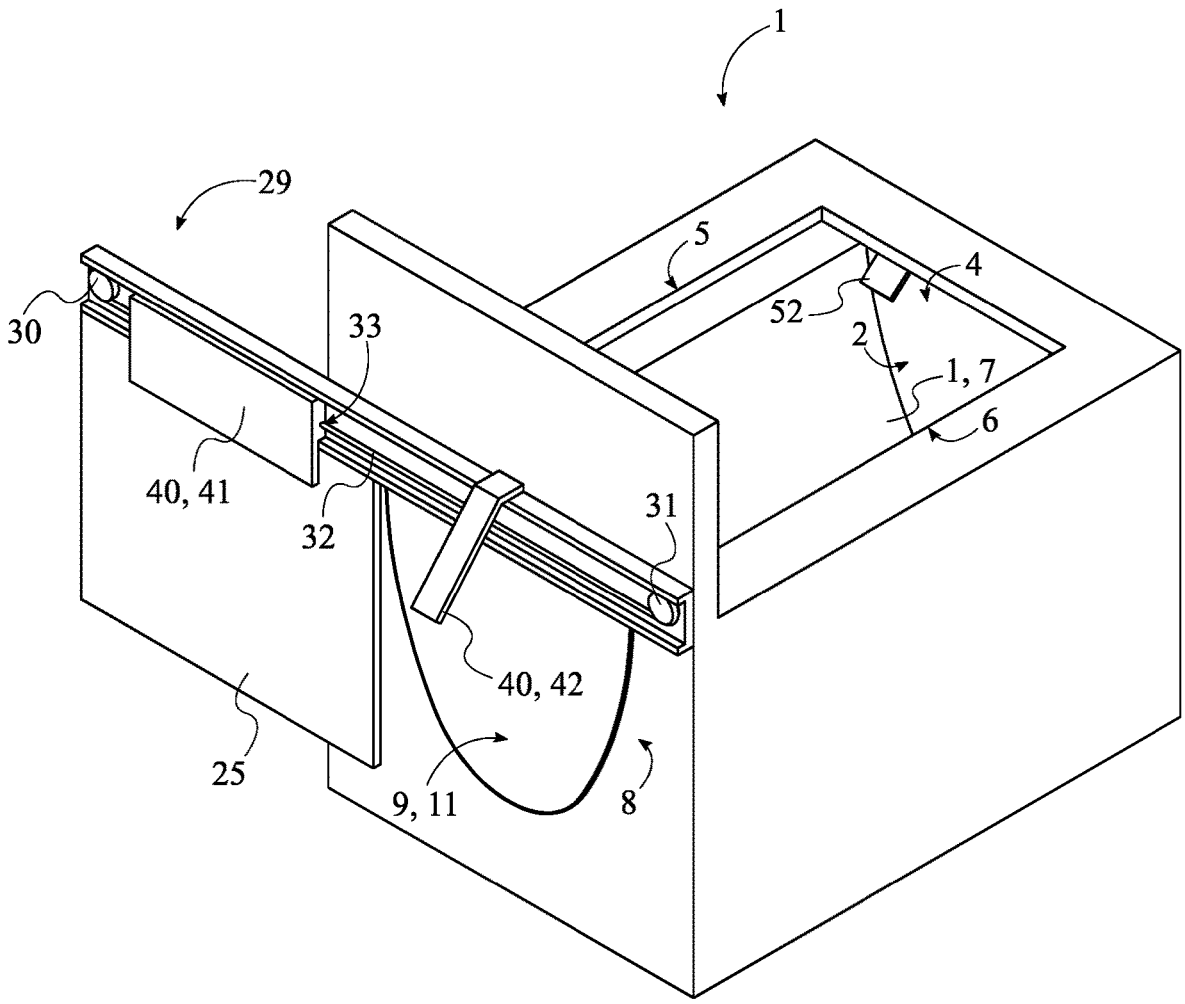
FIG. 17 is a top-rear-right perspective view thereof.
Figure 18:
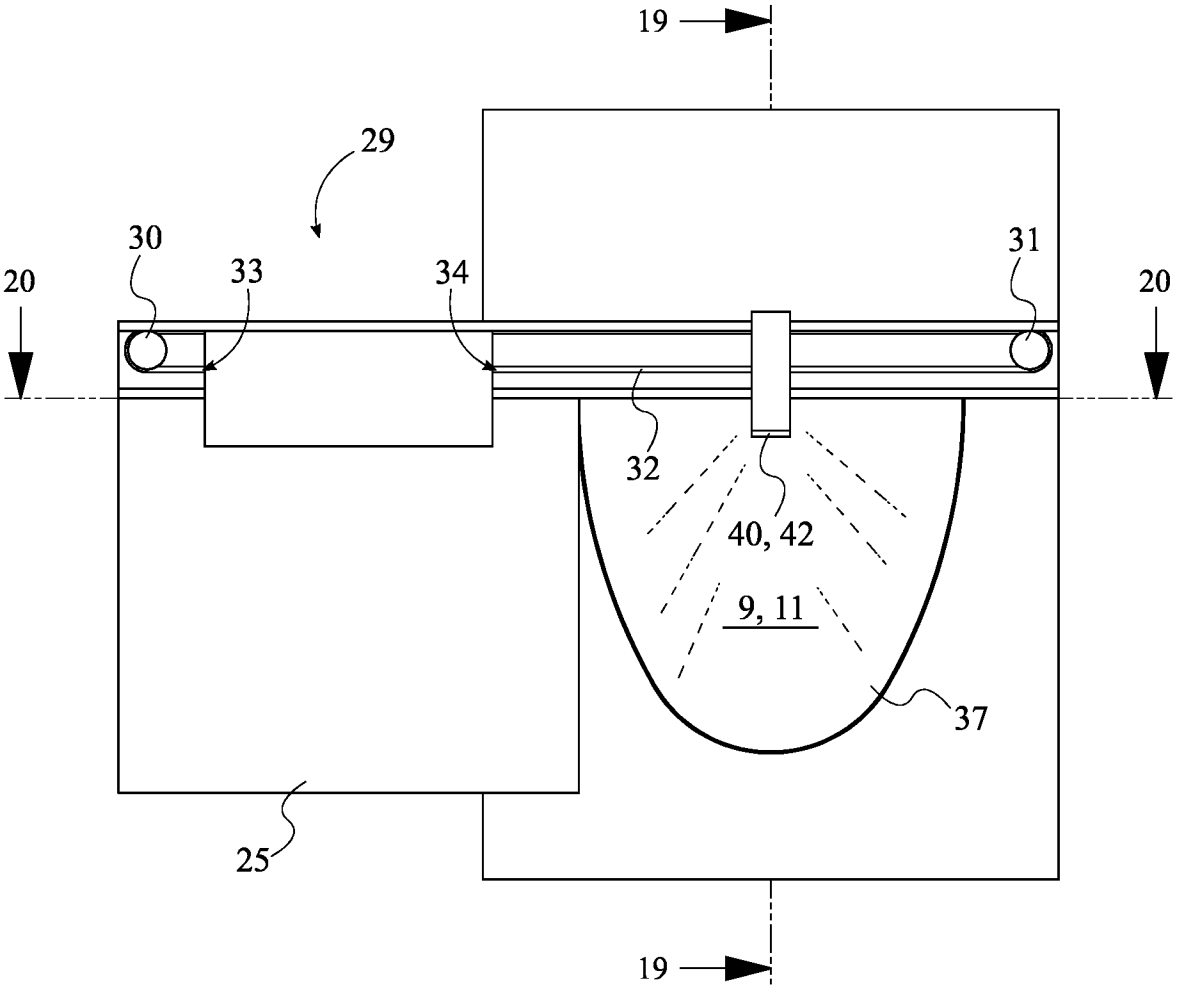
FIG. 18 is a rear view thereof.
Figure 19:
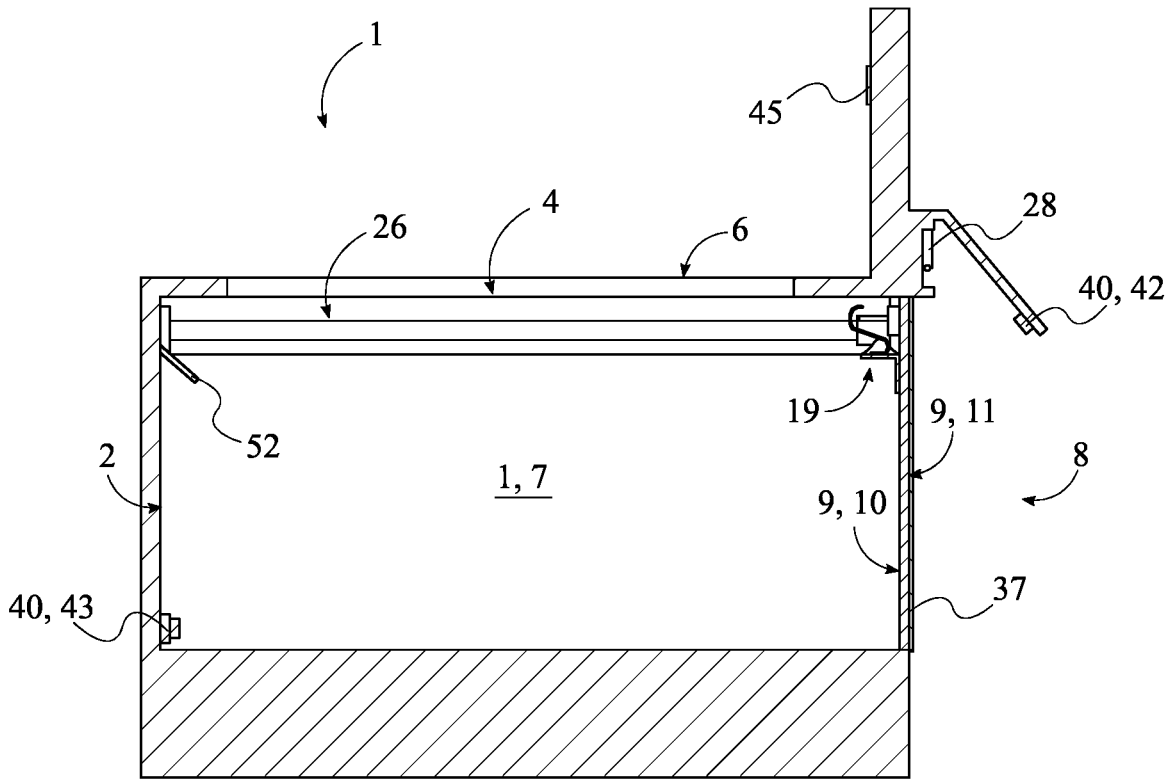
FIG. 19 is a vertical cross-sectional view taken along line 19-19 in FIG. 18.
Figure 20:
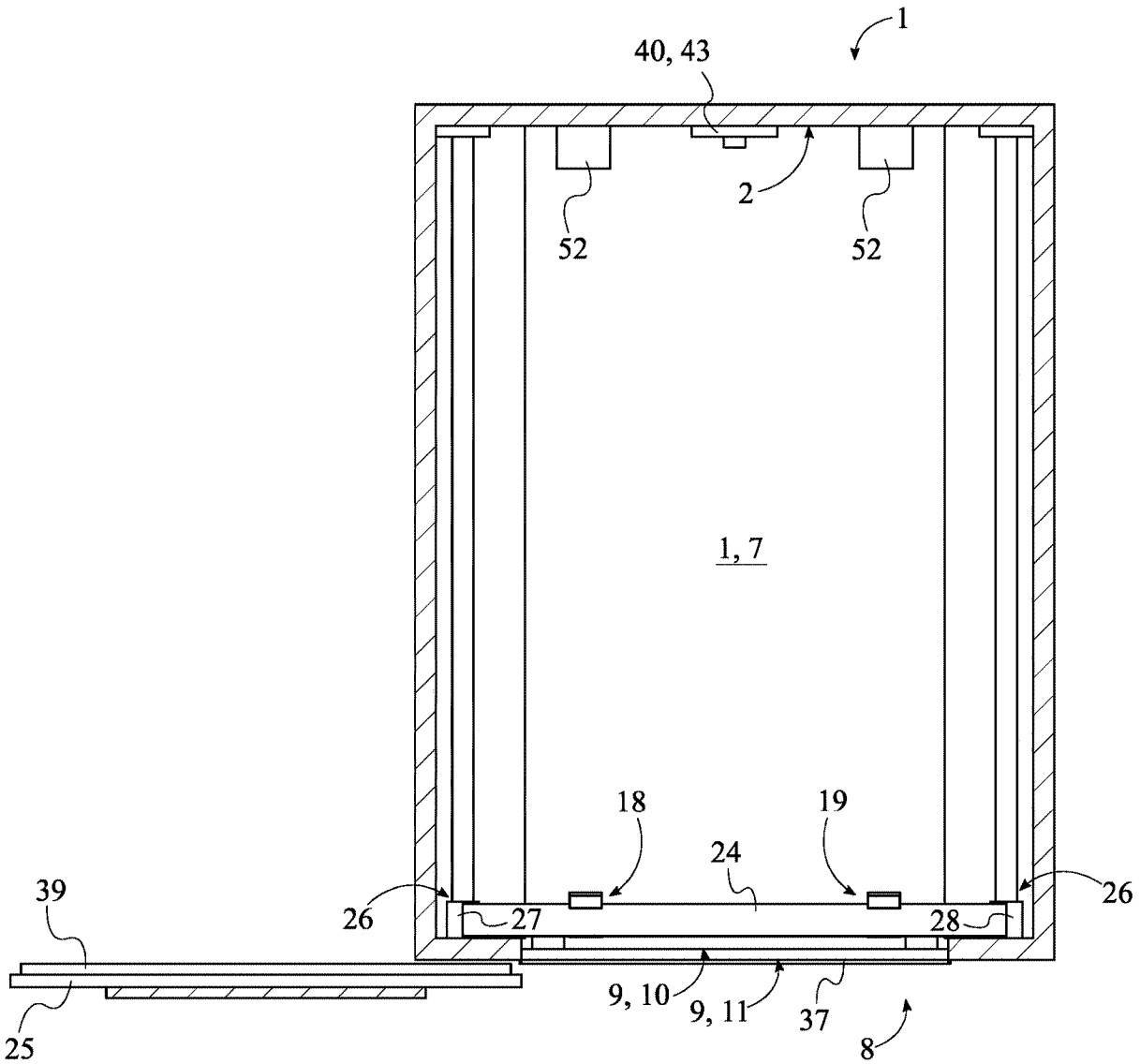
FIG. 20 is a horizontal cross-sectional view taken along line 20-20 in FIG. 18.
Figure 21:
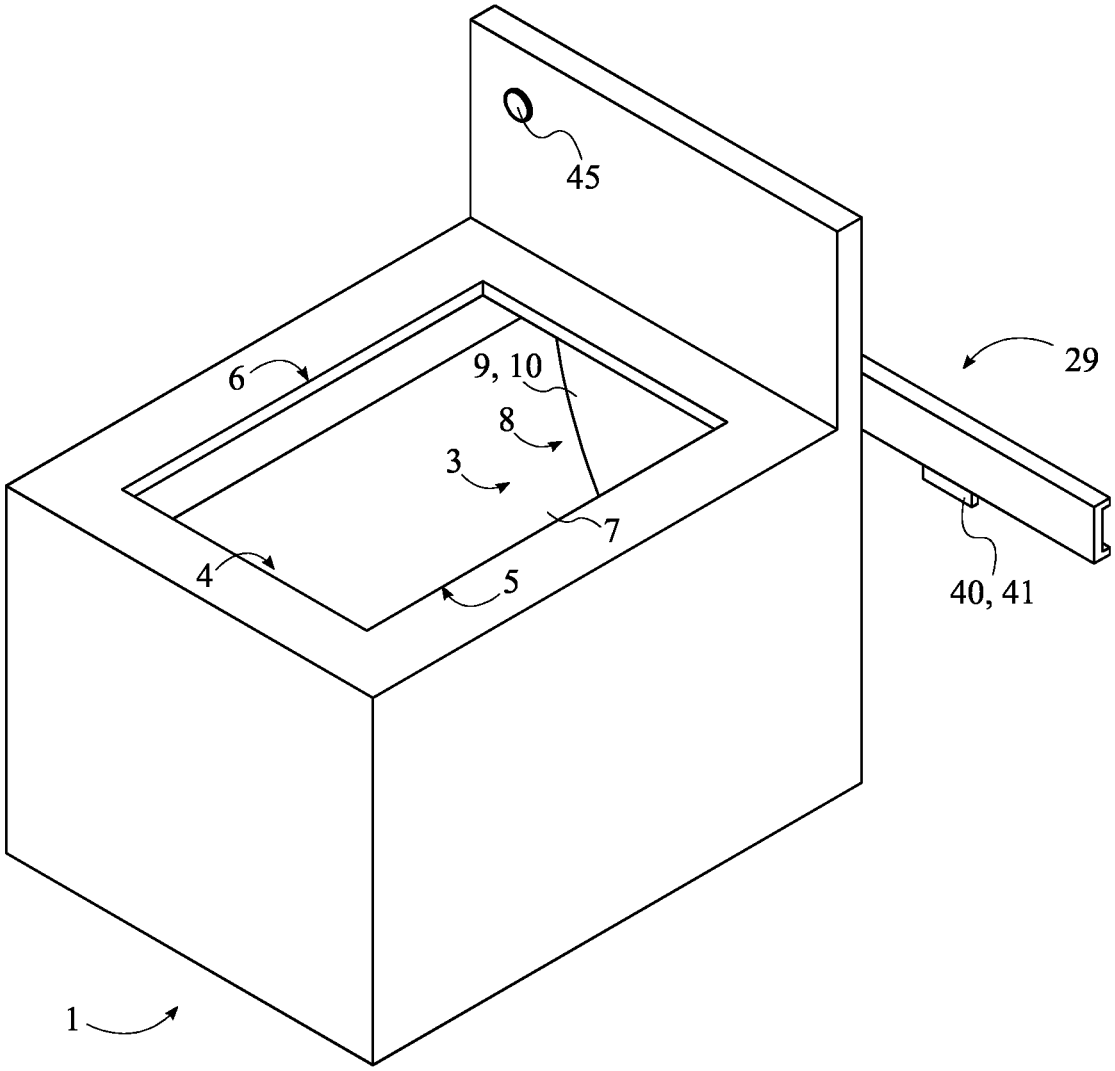
FIG. 21 is a top-front-left perspective view thereof, wherein the removal scraper is shown positioned at the open end, and wherein the back door is shown being moved towards the open end by the second translation mechanism.
Figure 22:
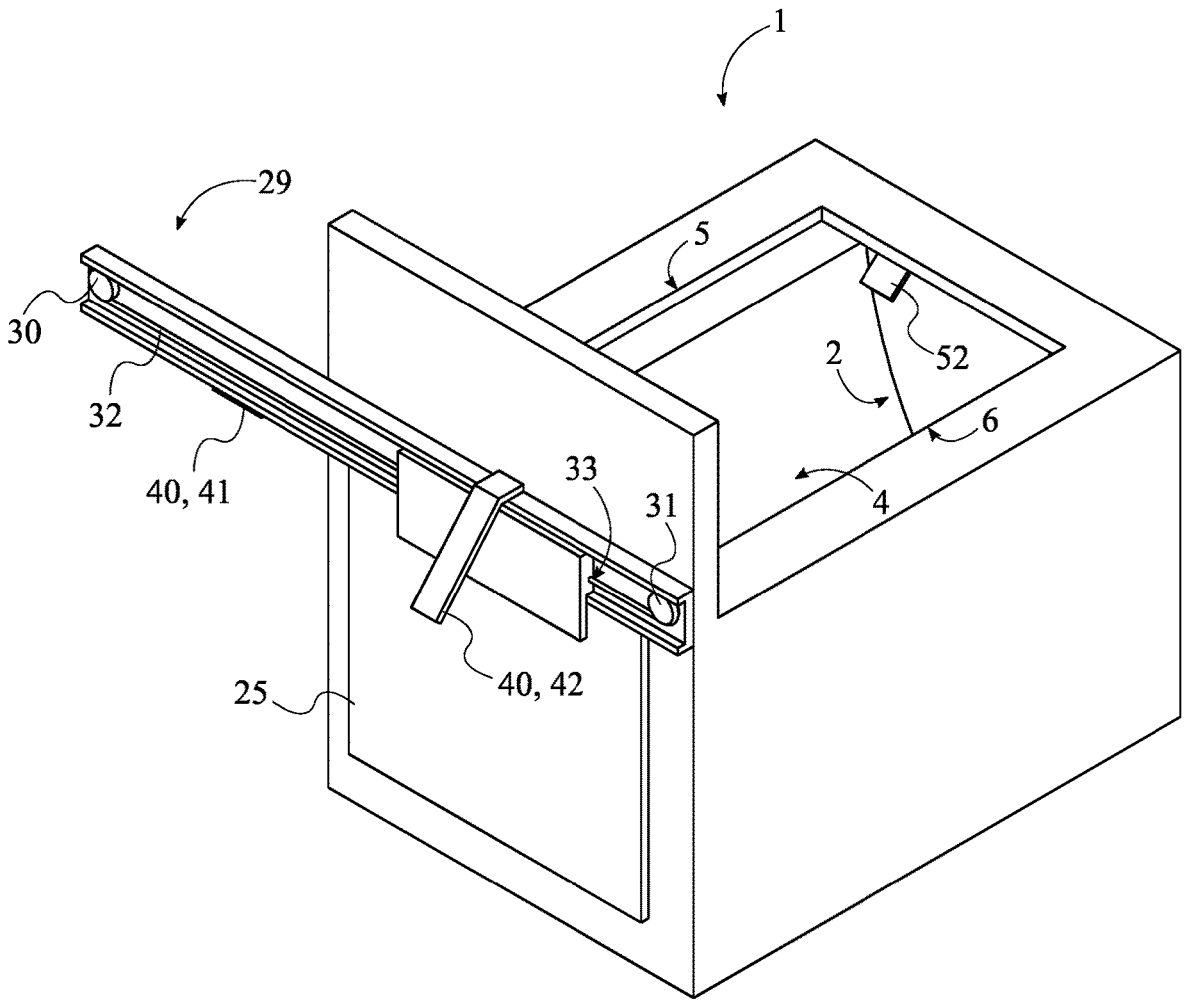
FIG. 22 is a top-rear-right perspective view thereof.
Figure 23:
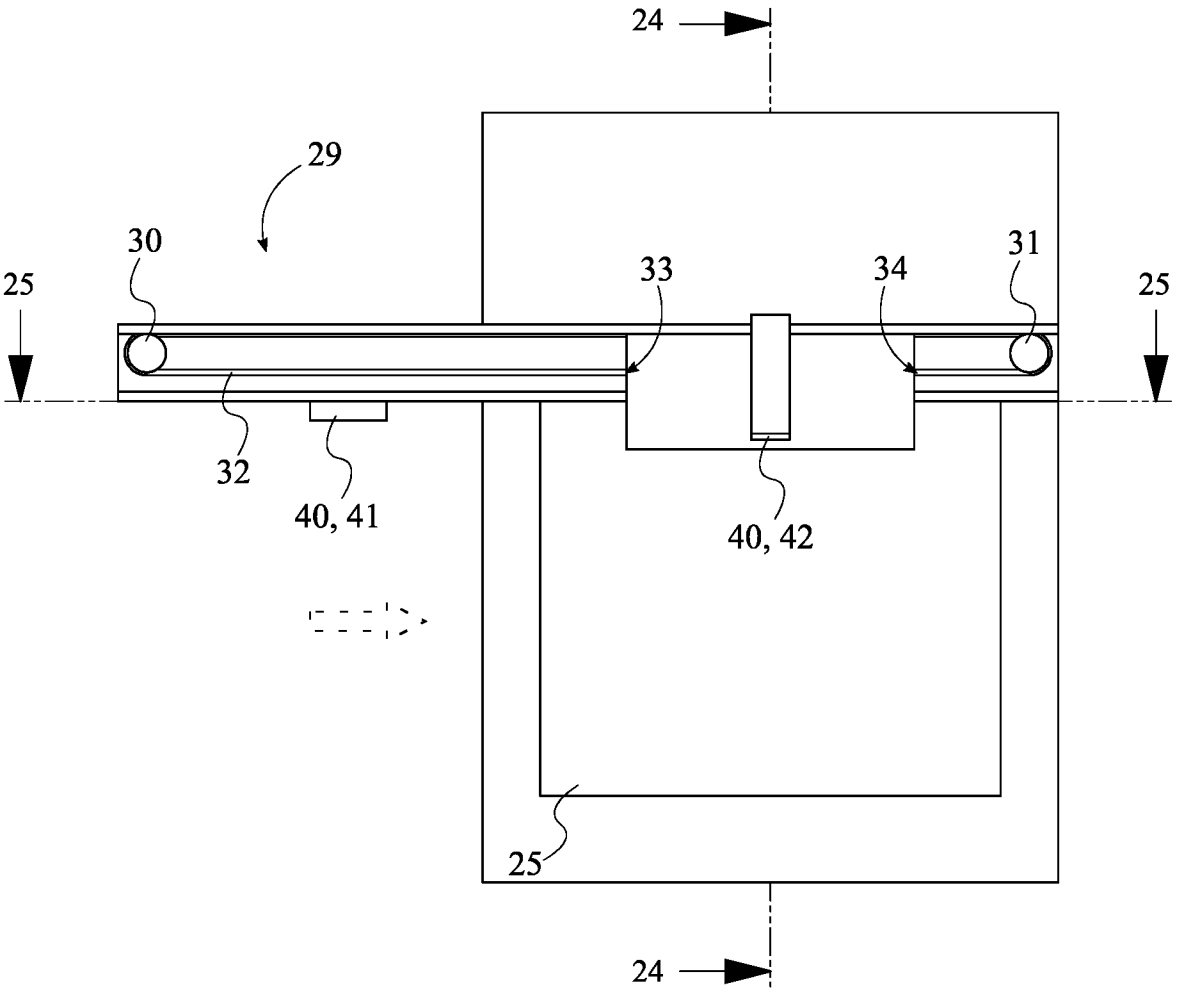
FIG. 23 is a rear view thereof.
Figure 24:
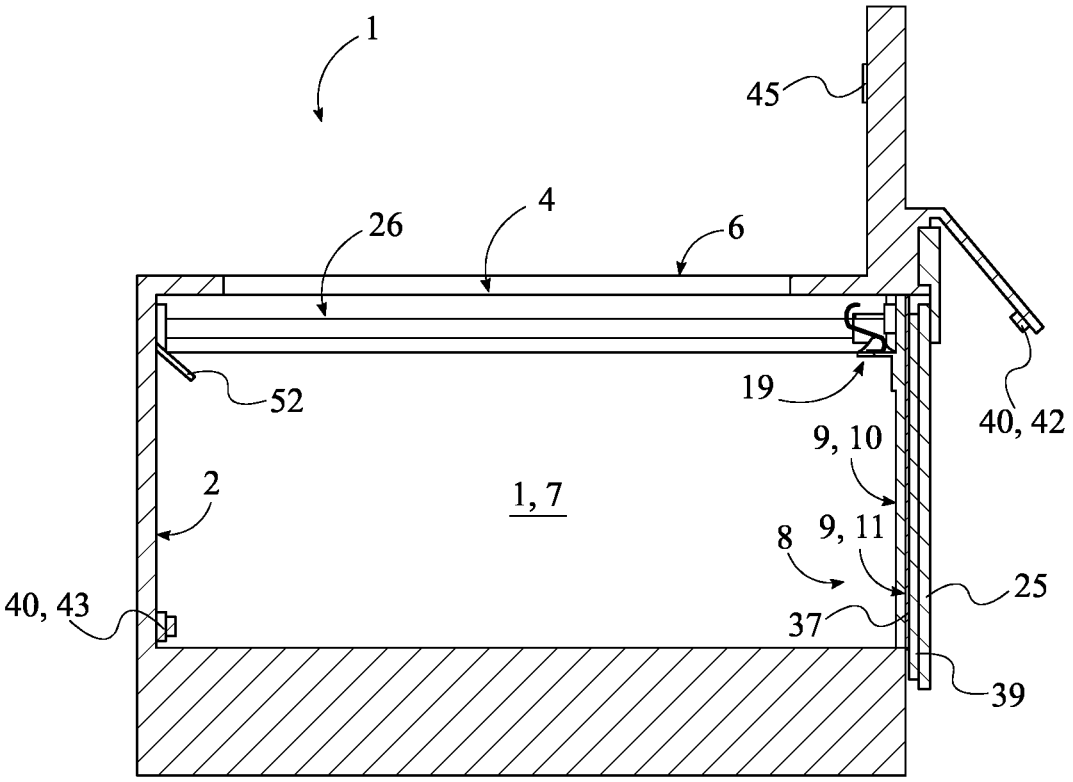
FIG. 24 is a vertical cross-sectional view taken along line 24-24 in FIG. 23.
Figure 25:
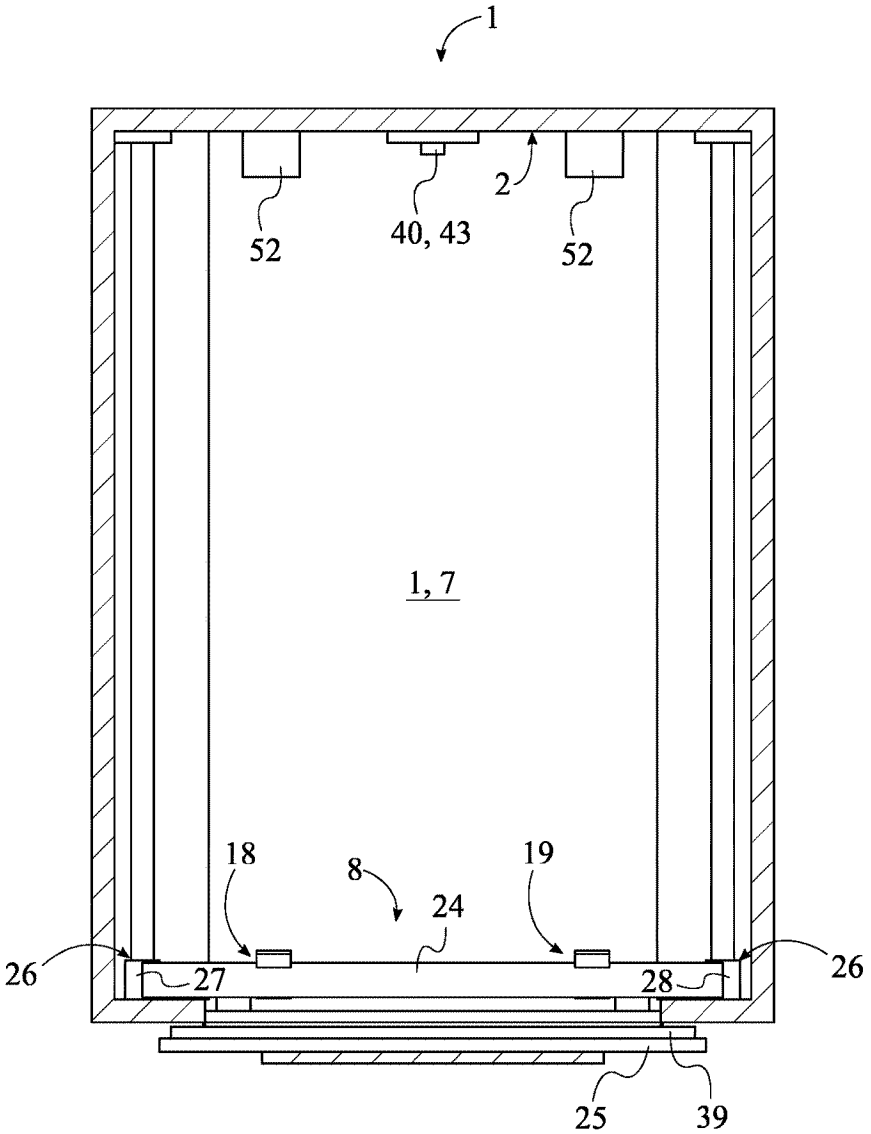
FIG. 25 is a horizontal cross-sectional view taken along line 25-25 in FIG. 23.
Figure 26:
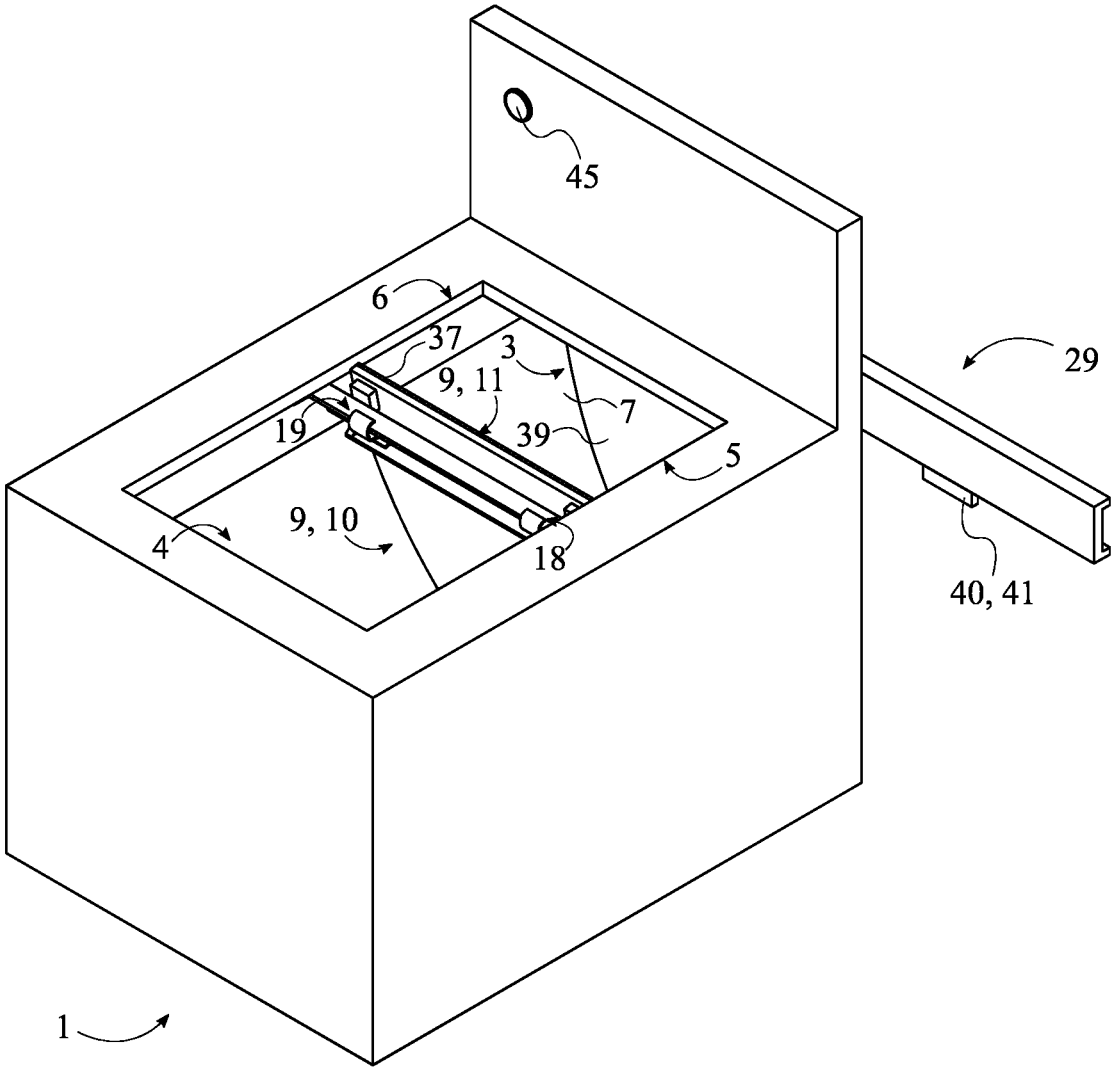
FIG. 26 is a top-front-left perspective view thereof, wherein the removal scraper is shown being moved towards the closed end by the first translation mechanism.
Figure 27:
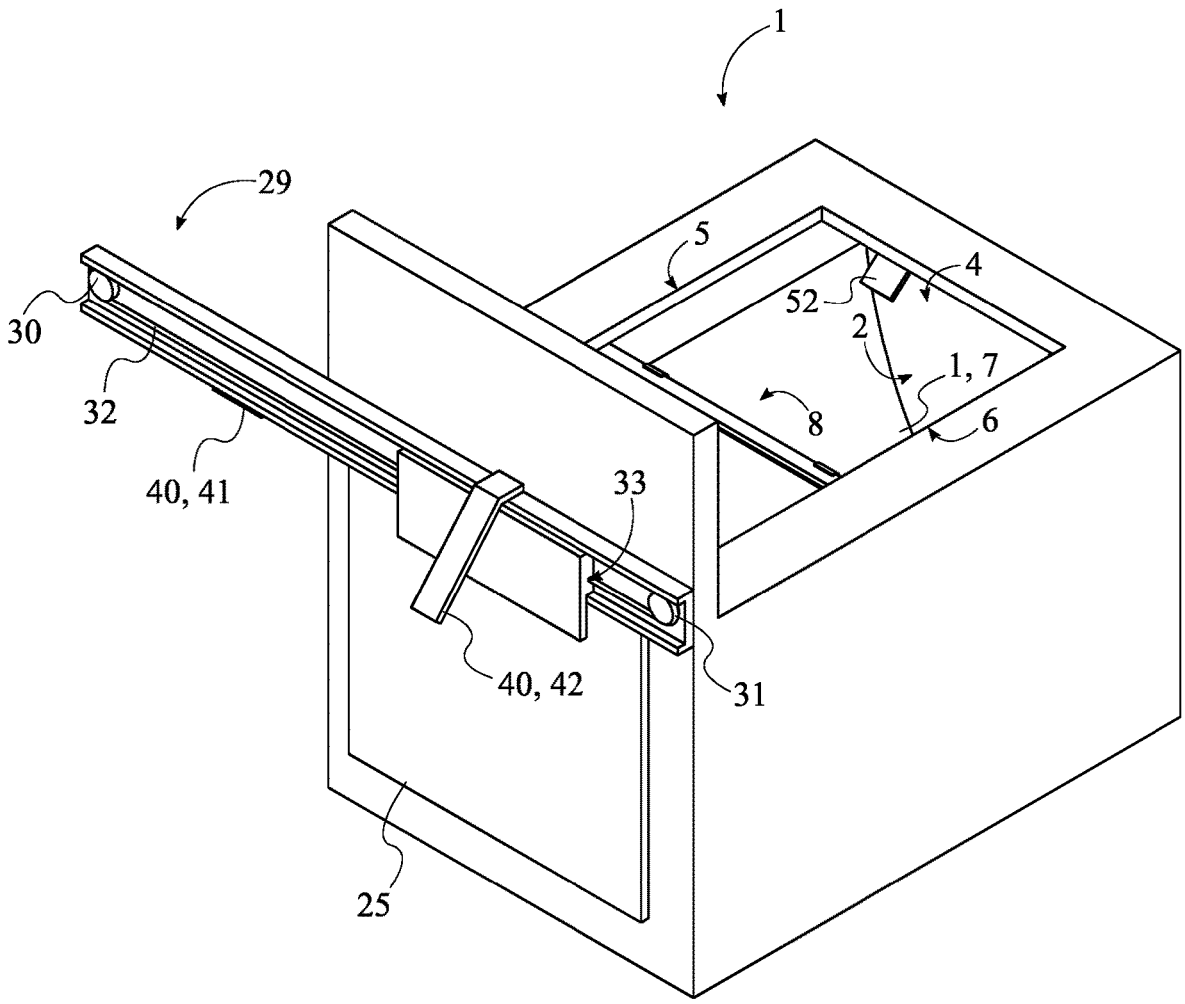
FIG. 27 is a top-rear-right perspective view thereof.
Figure 28:
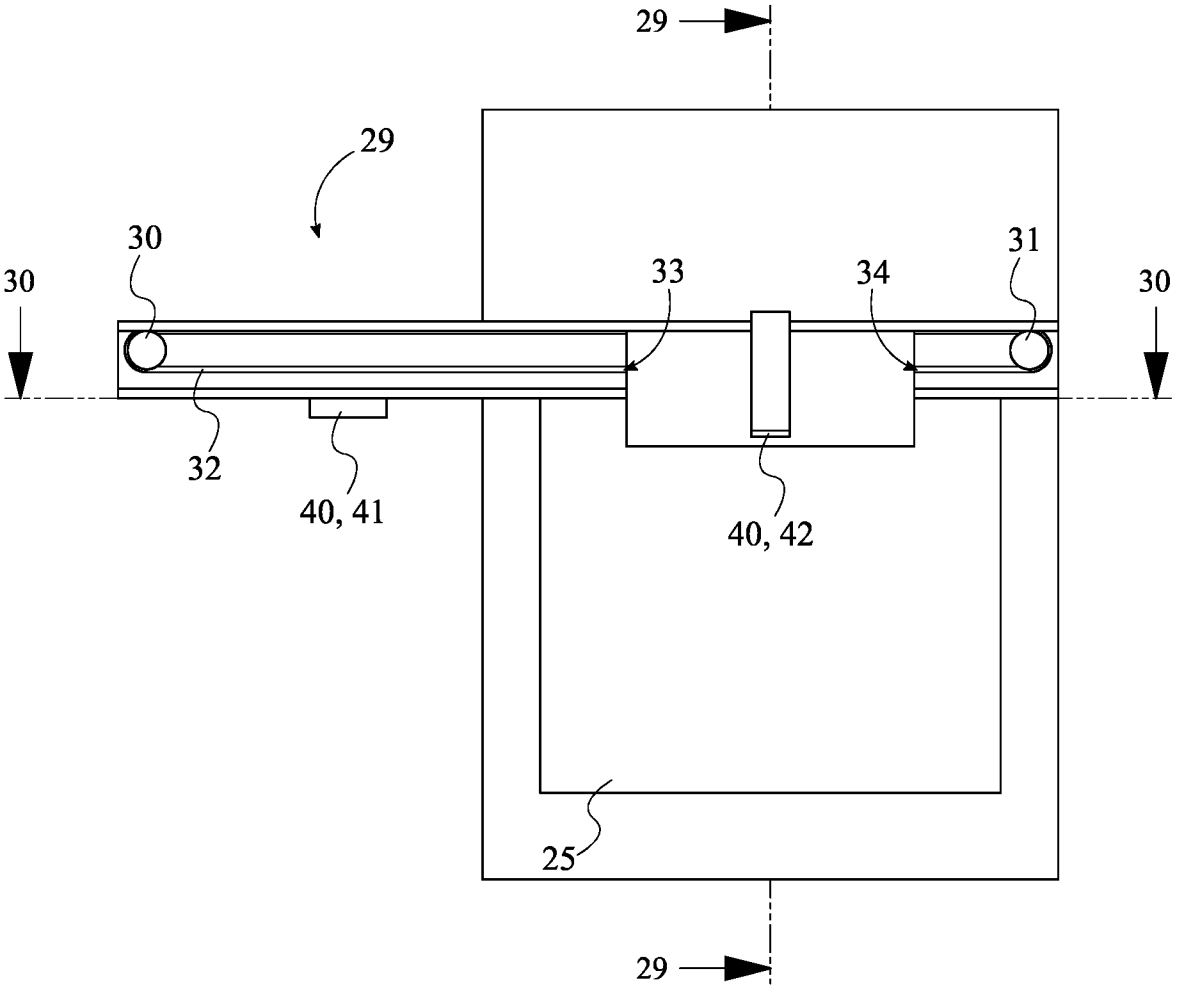
FIG. 28 is a rear view thereof.
Figure 29:
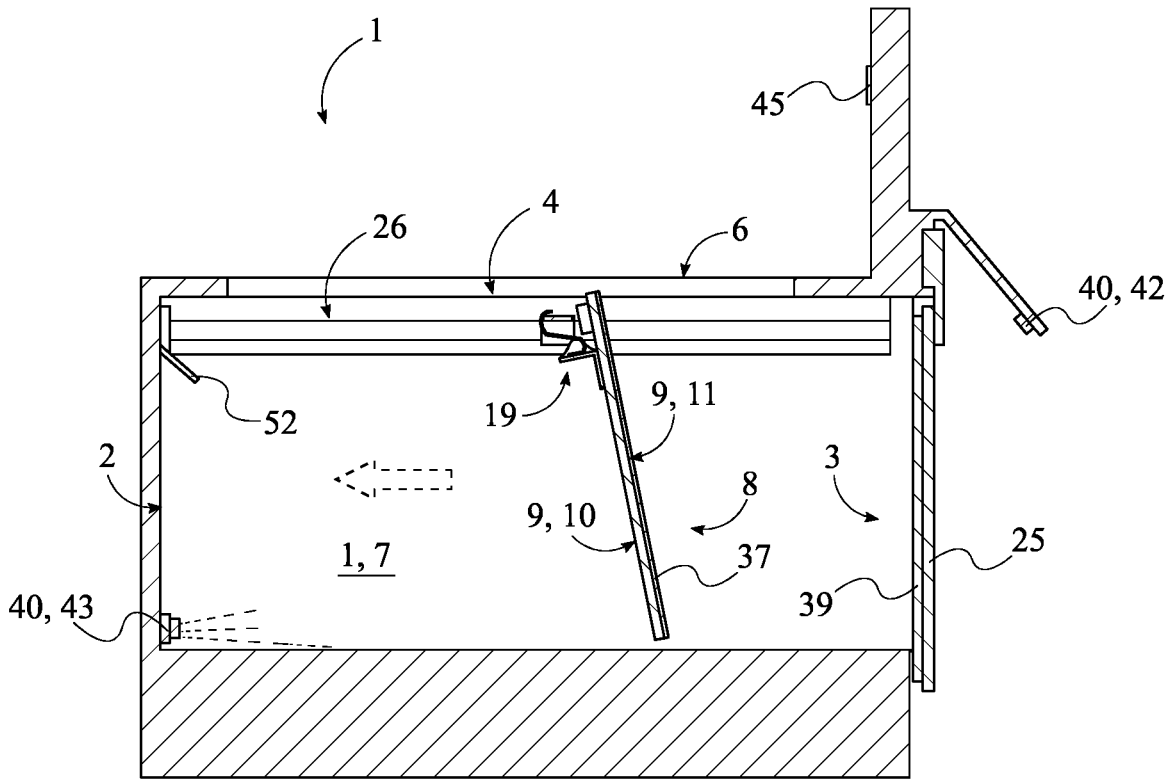
FIG. 29 is a vertical cross-sectional view taken along line 29-29 in FIG. 28.
Figure 30:
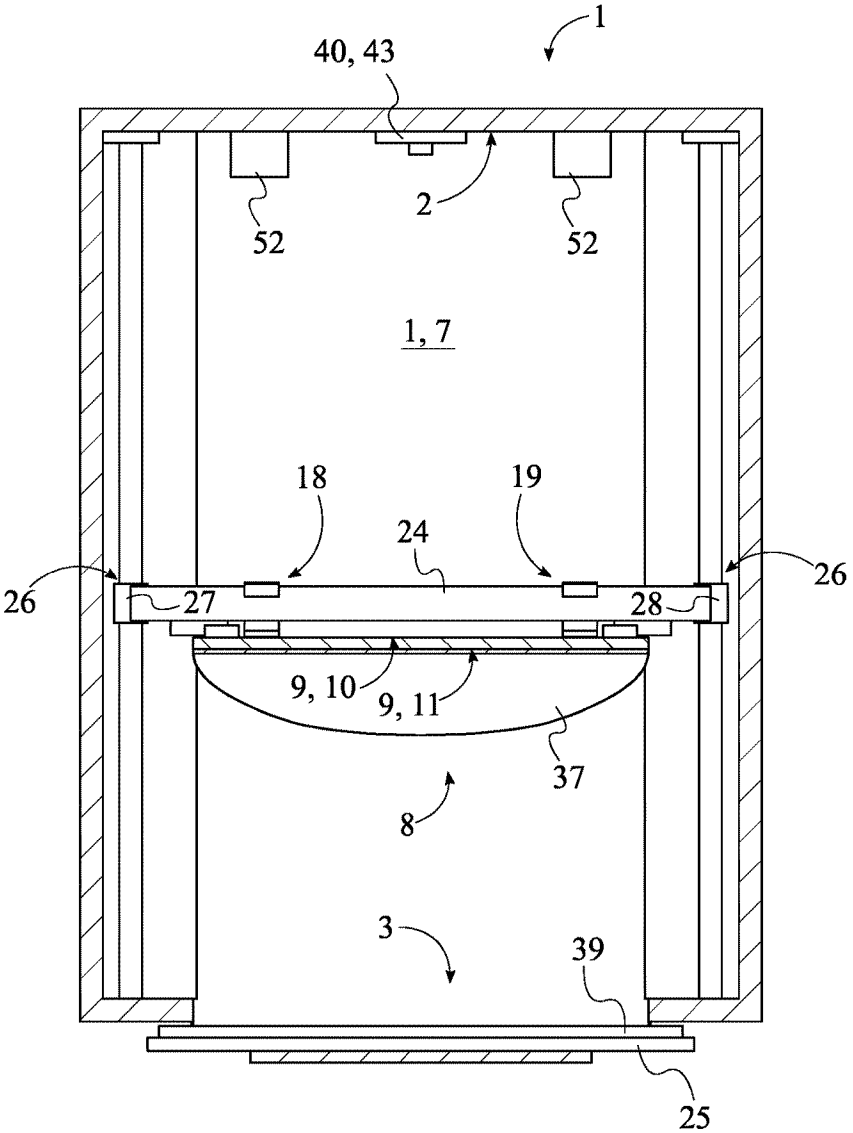
FIG. 30 is a horizontal cross-sectional view taken along line 30-30 in FIG. 28.
Figure 31:
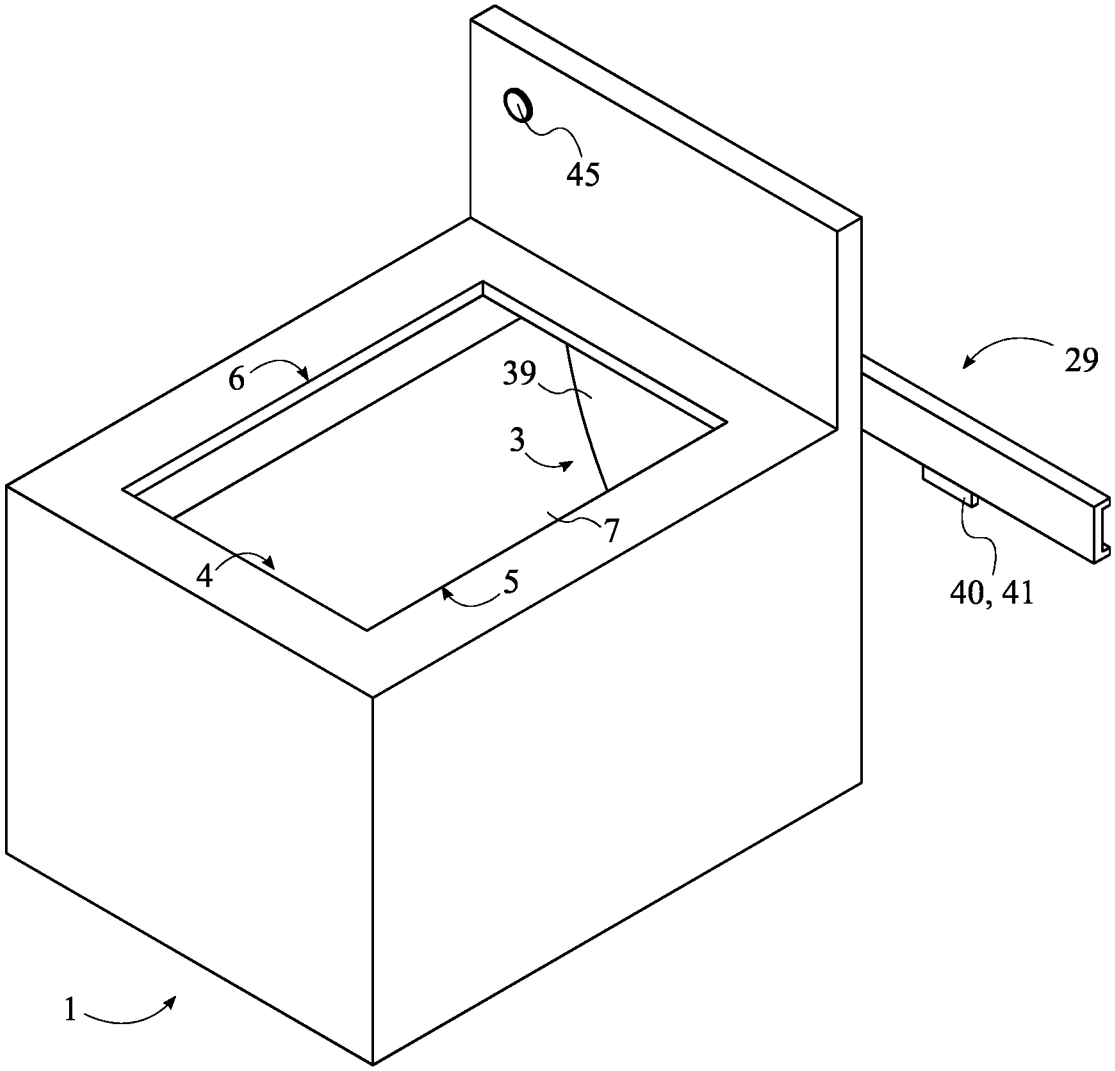
FIG. 31 is a top-front-left perspective view thereof, wherein the removal scraper is shown being repositioned to the starting position.
Figure 32:
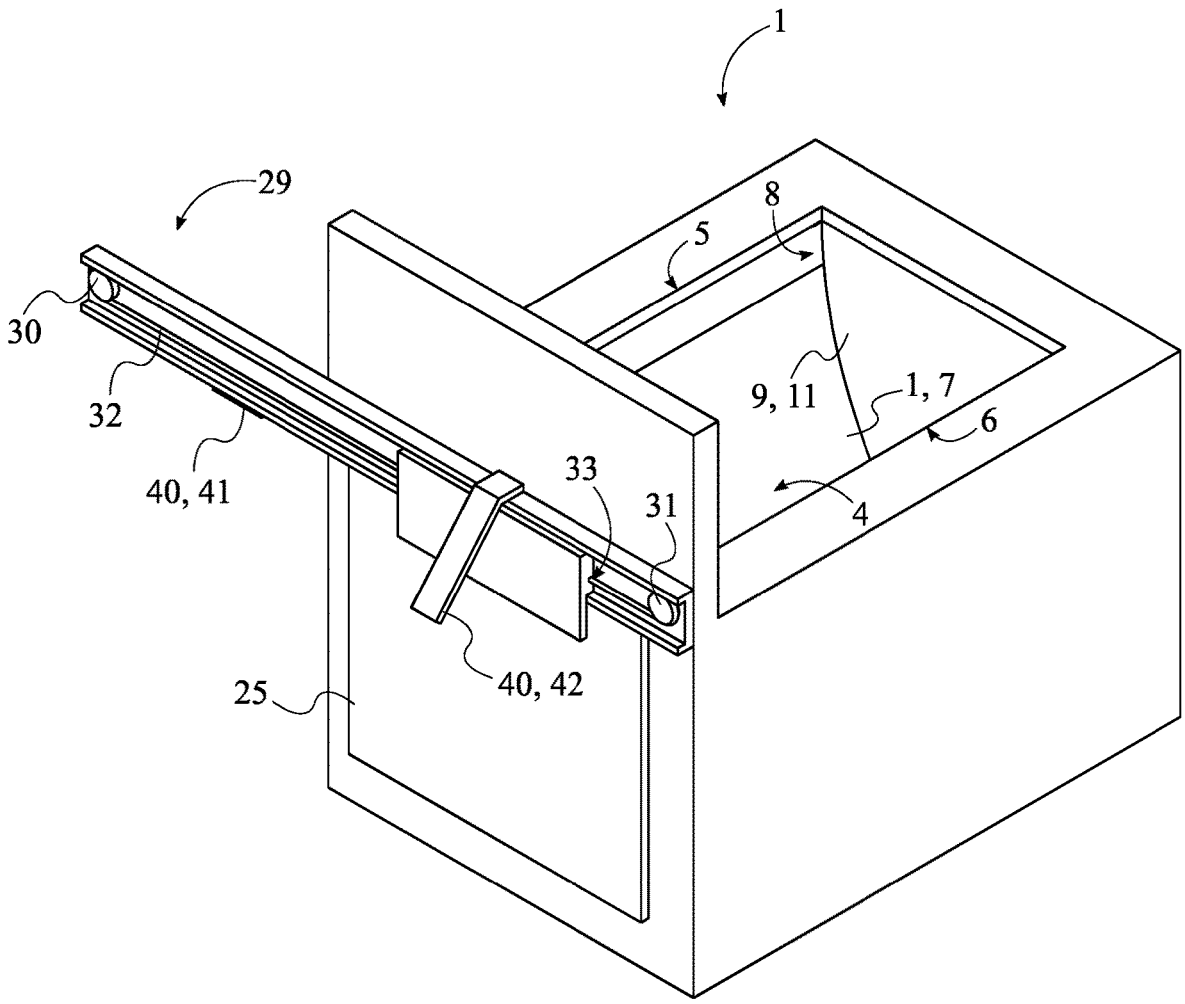
FIG. 32 is a top-rear-right perspective view thereof.
Figure 33:
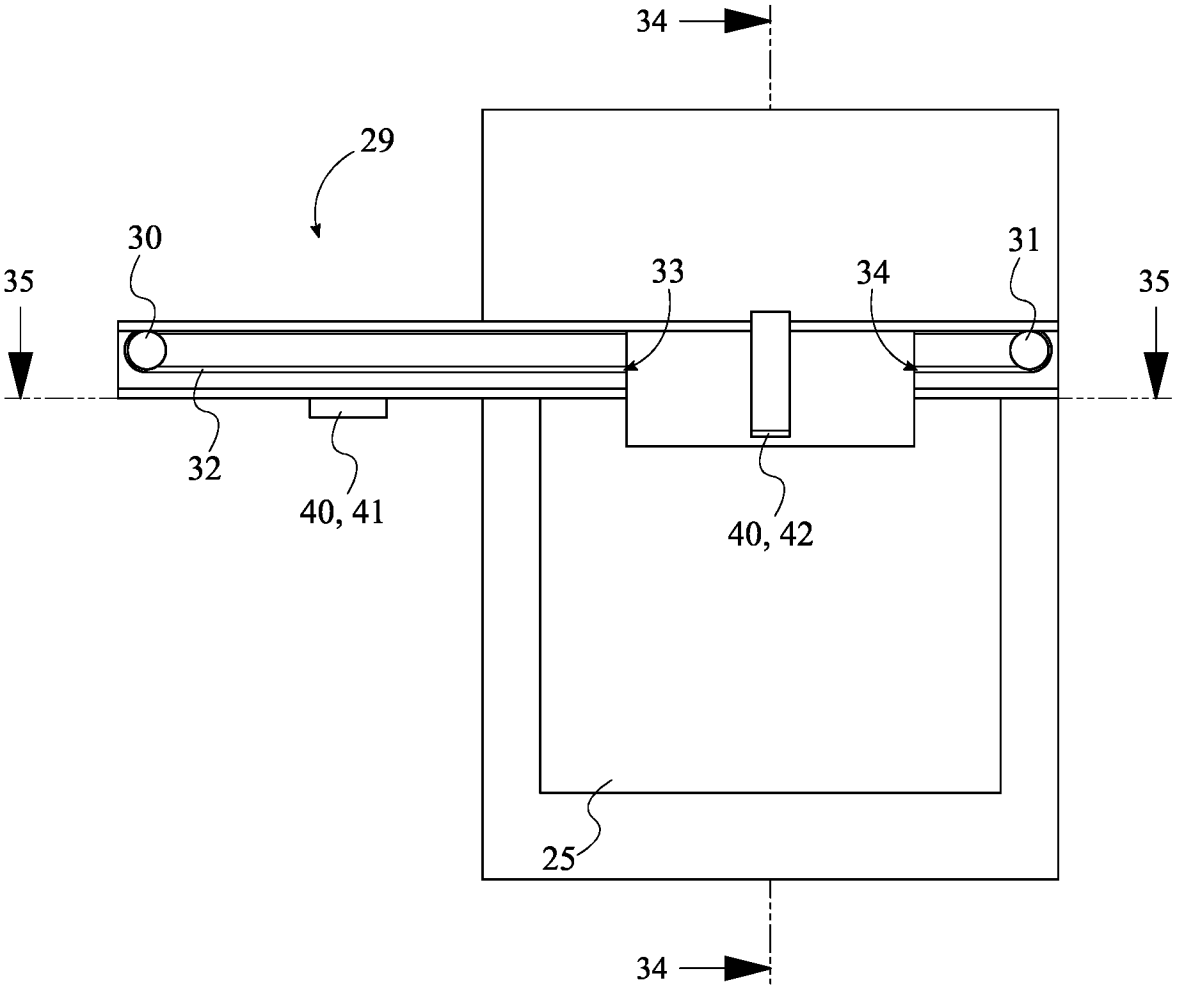
FIG. 33 is a rear view thereof.

In addition to the at least one first spray nozzle 41, the plurality of spray nozzles 40 may further comprise at least one second spray nozzle 42 that is preferably configured to spray fluids onto the rearward face 11 after the removal scraper 8 has moved the collected excrement out of the receiving trough 1 through the open end 3. As can be seen in FIGS. 17 through 19, the at least one second spray nozzle 42 is mounted adjacent to the open end 3 so that the at least one second spray nozzle 42 is positioned next to removal scraper 8 when the removal scraper 8 is moved adjacent to the open end 3 by the first translation mechanism 26. Further, the at least one second spray nozzle 42 is oriented towards the open end 3 so that when fluids are sprayed by the at least one second spray nozzle 42, the fluids are dispensed onto the rearward face 11 of the removal scraper 8 as well as the rear edge of the receiving through 1.

Figure 34:
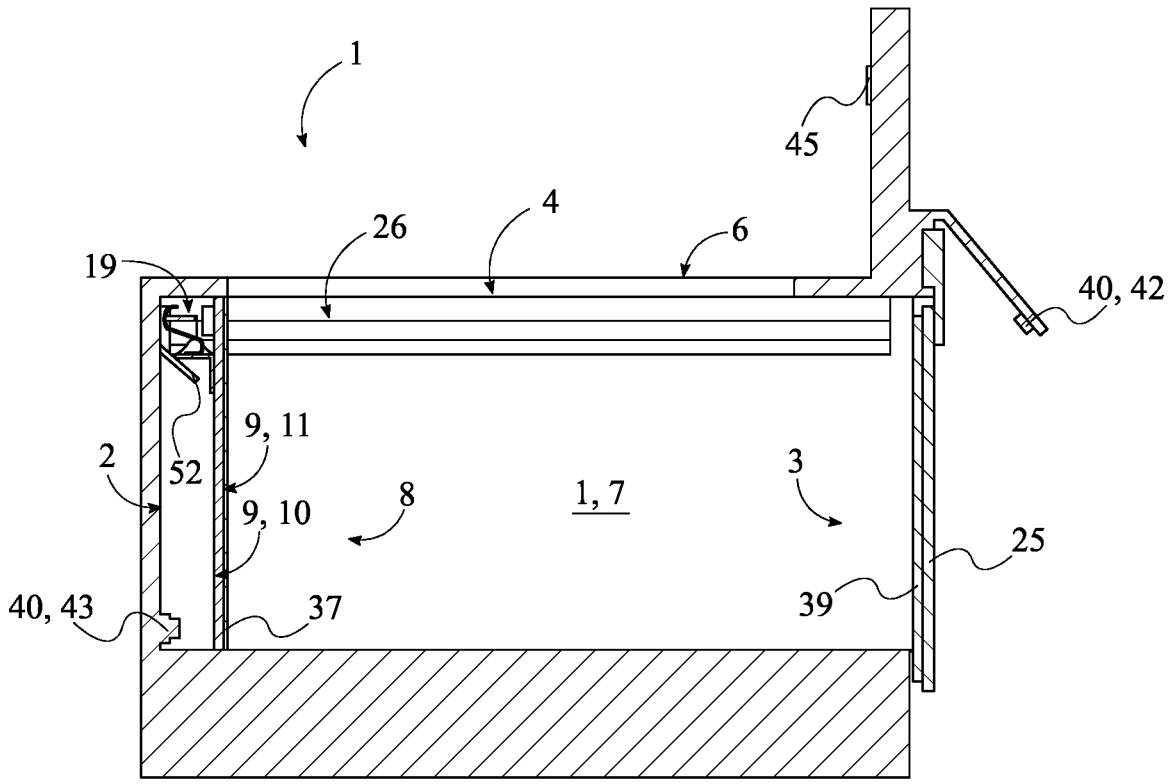
FIG. 34 is a vertical cross-sectional view taken along line 34-34 in FIG. 33.
Figure 35:
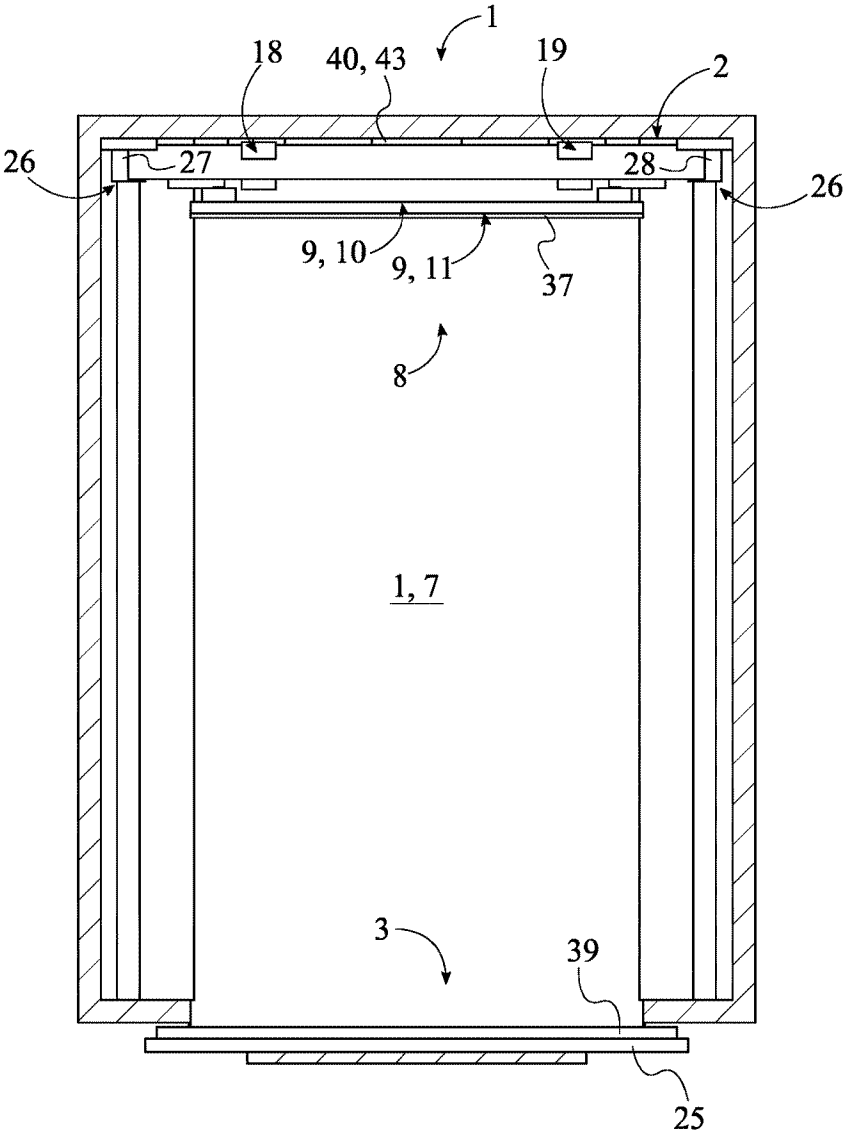
FIG. 35 is a horizontal cross-sectional view taken along line 35-35 in FIG. 33.
Figure 36:
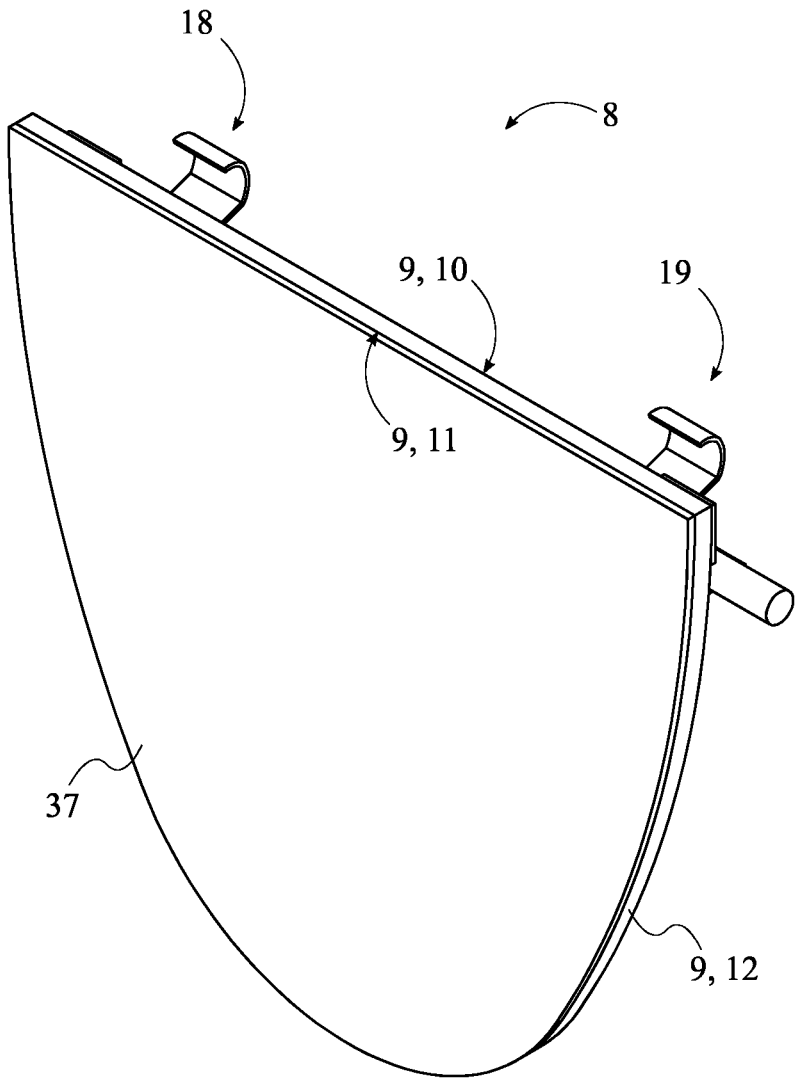
FIG. 36 is a top-front-left perspective view of the removal scraper of the present invention.
Figure 37:
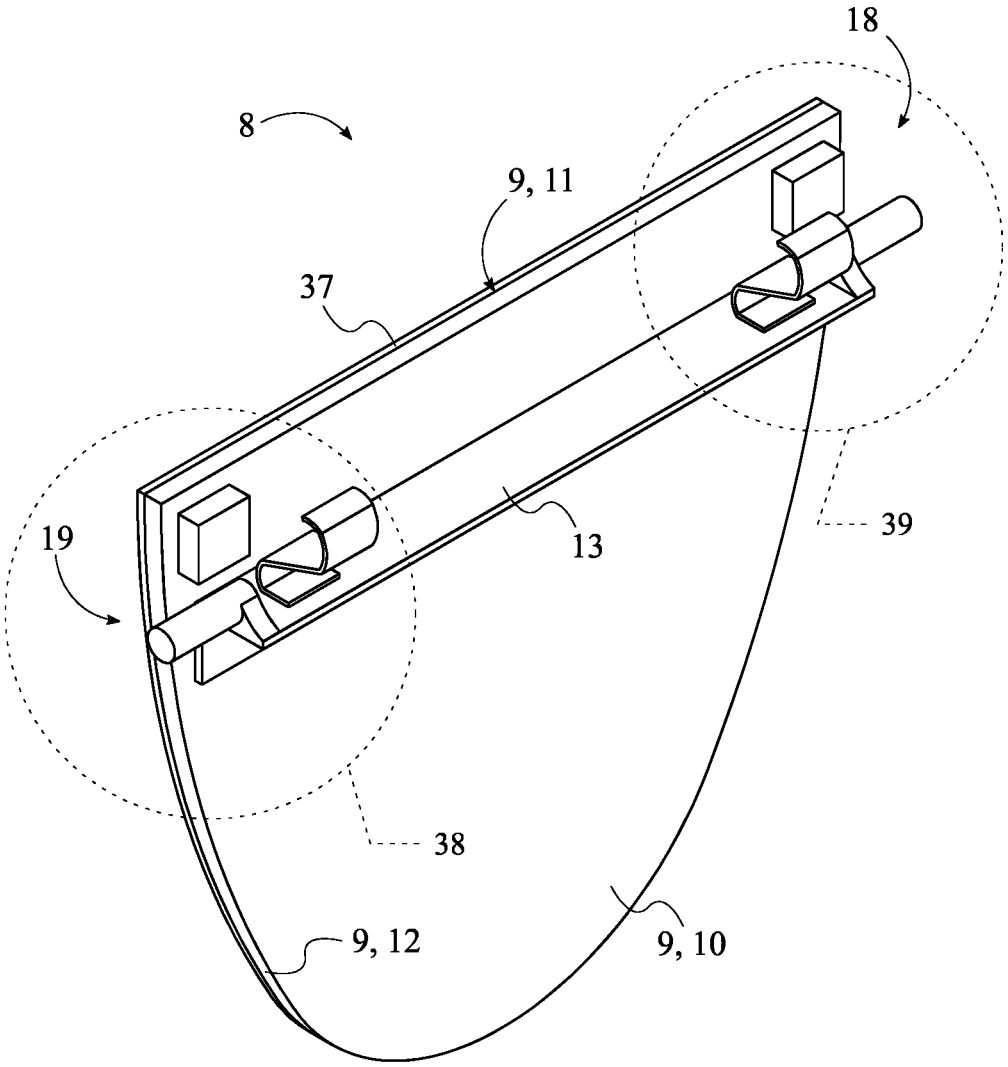
FIG. 37 is a top-rear-left perspective view of the removal scraper of the present invention.
Figure 38:
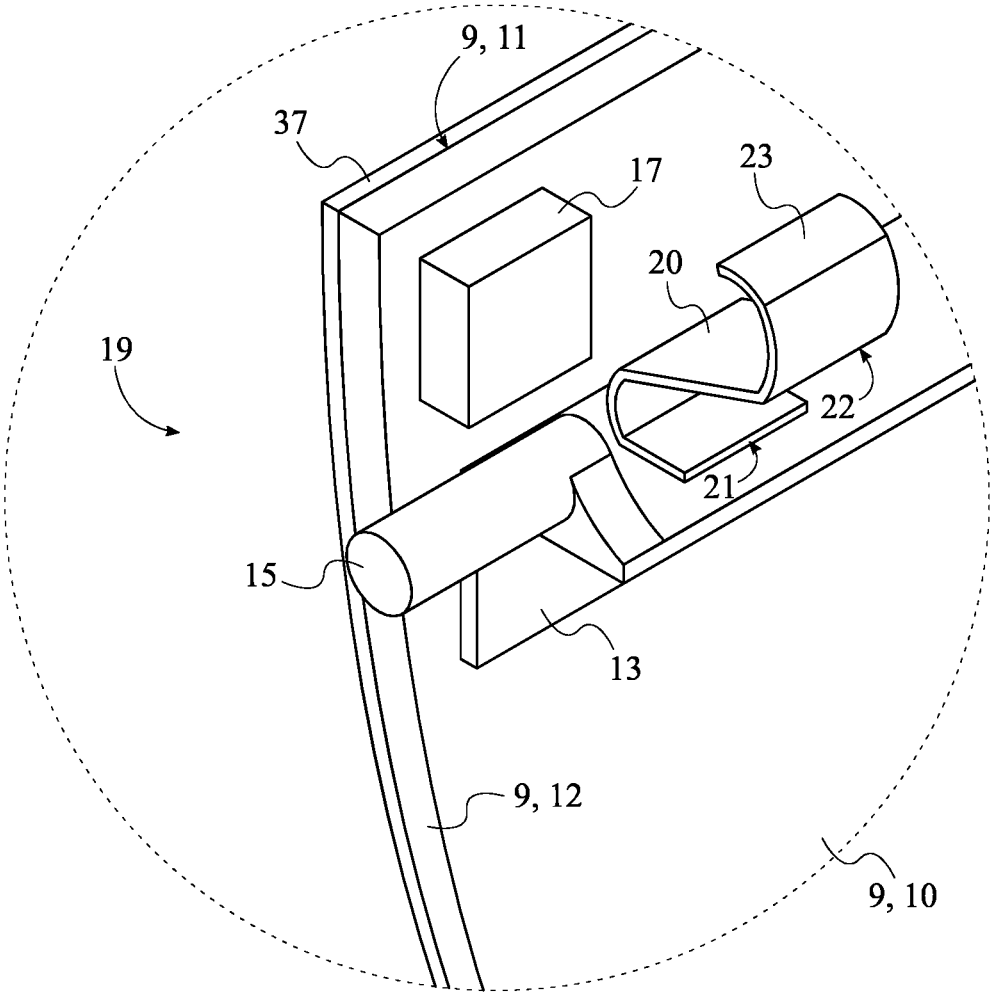
FIG. 38 is a magnified view of the second catcher of the removal scraper of the present invention.
Figure 39:
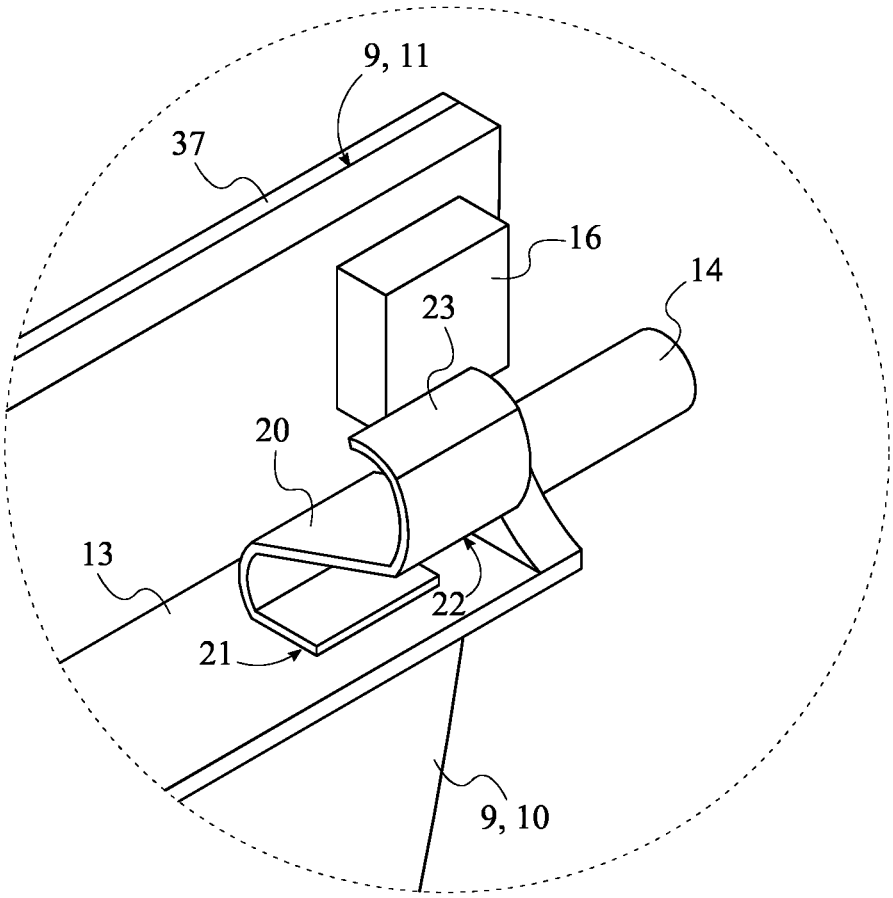
FIG. 39 is a magnified view of the first catcher of the removal scraper of the present invention.
Figure 40:
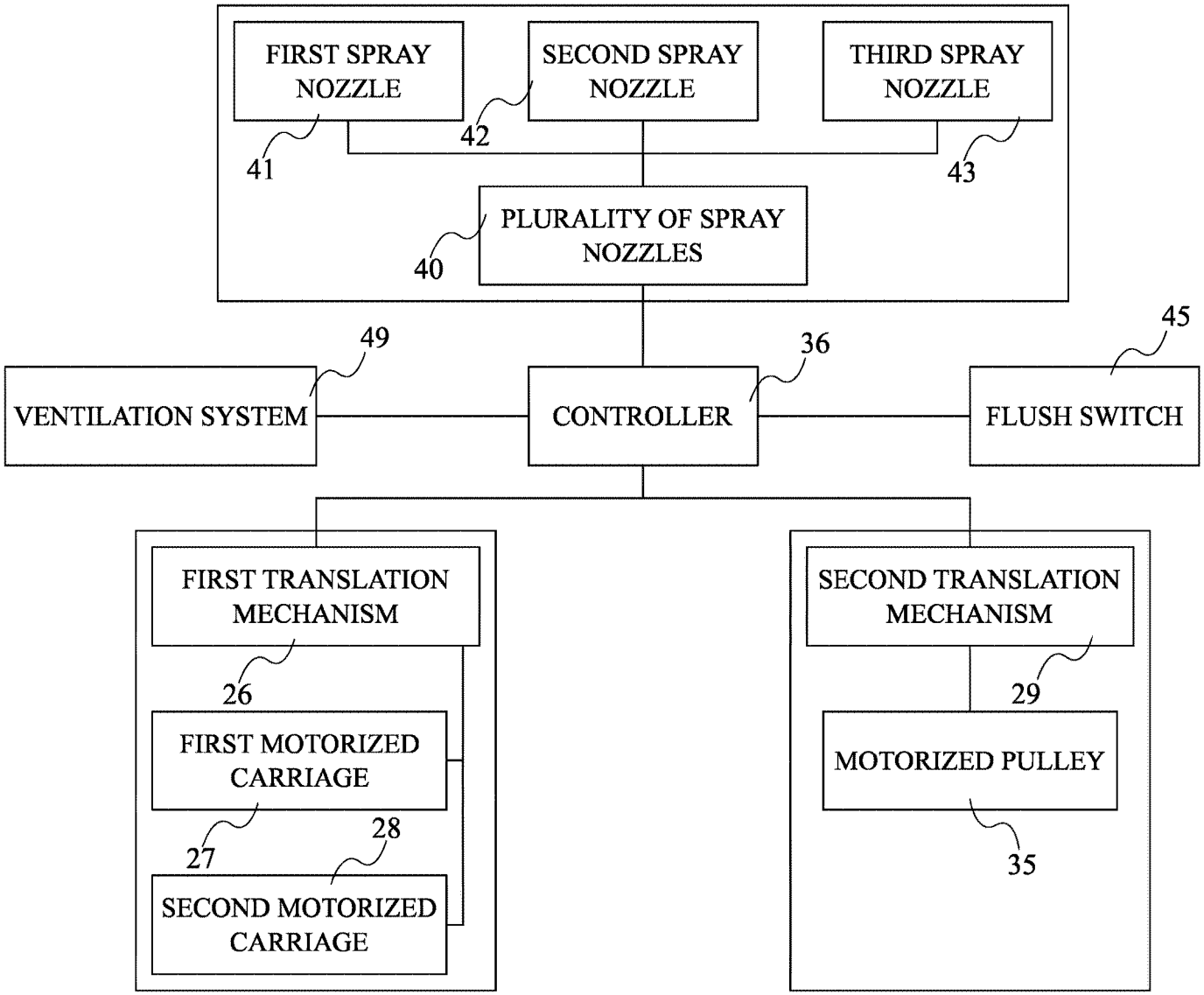
FIG. 40 is a diagram illustrating the electronic connections of the electronic components of the present invention.
Figure 41:
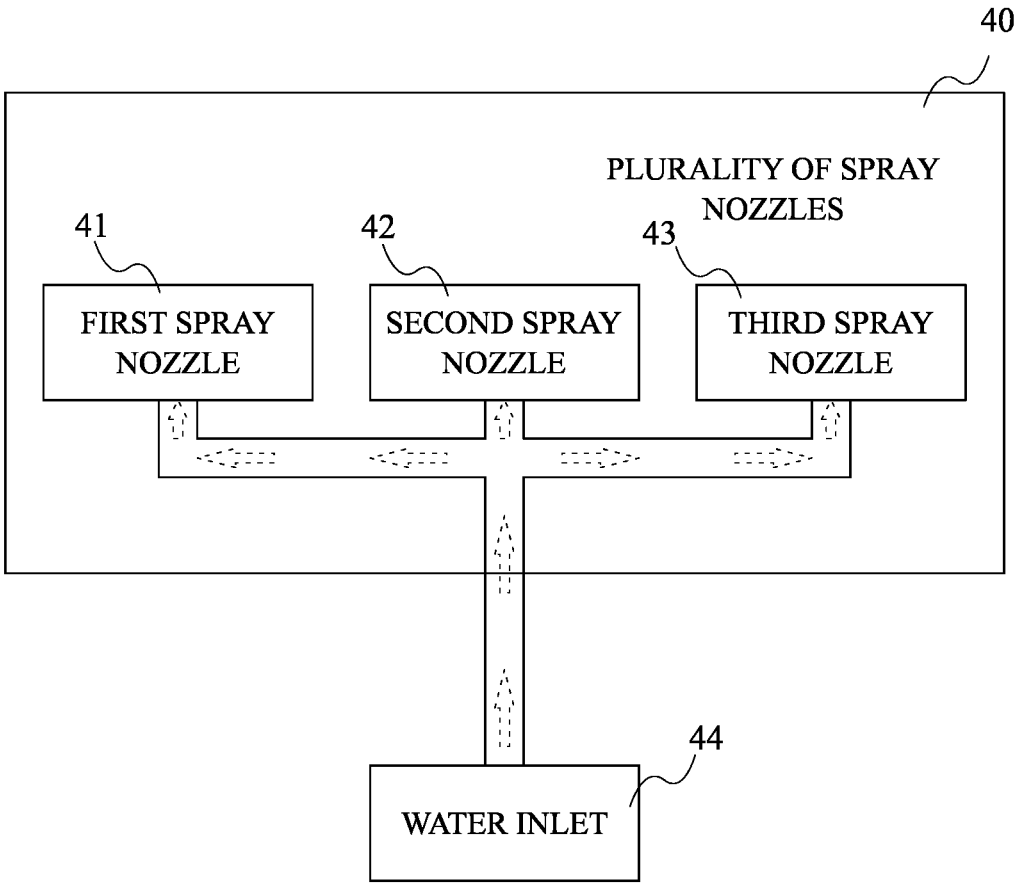
FIG. 41 is a diagram illustrating the fluid communication between the water inlet and the plurality of spray nozzles of the present invention.

In addition to the at least one second spray nozzle 42, the plurality of spray nozzles 40 may further comprise at least one third spray nozzle 43 that is preferably configured to spray fluids onto the concave surface 7 of the receiving trough 1. The at least one third spray nozzle 43 can be used to wet the concave surface 7 to prepare the concave surface to be wiped again by the removal scraper 8, or to splash the concave surface 7 with more water as programmed, depend on embodiments. The at least one third spray nozzle 43 also serves to splash around the edge of the removal scraper 8 as well as the bottom area of concave surface 7 between the removal scraper 8 and the closed end 2. As can be seen in FIG. 34, the at least one third spray nozzle 43 is preferably engaged after the removal scraper 8 has been moved back to the closed end 2 by the first translation mechanism 26, before the convex edge 12 is repositioned against the concave surface 7, to ensure any residual excrement left on the concave surface 7 and any residual excrement left around the convex edge 12 are washed away. To do so, the at least one third spray nozzle 43 is positioned within the receiving trough 1. The at least one third spray nozzle 43 is also mounted adjacent to the closed end 2. Further, the at least one third spray nozzle 43 is oriented towards the open end 3. This way, when the at least one third spray is engaged to dispense fluids, the fluids are dispensed onto the concave surface 7. The dispensed fluids flow down the concave surface 7 as the receiving trough 1 have a slanted base. Then, the dispensed fluids along with any residual excrement exits through the open end 3. In case that only very small amount of water is used, the first translation mechanism 26 may be engaged continuously to move the removal scraper 8 back and forth along the receiving trough 1 to wipe the concave surface 7 repeatedly to achieve the desired sanitation levels. Furthermore, the at least one third spray nozzle 43 may be several third spray nozzles positioned at different location around the receiving trough 1 to cover all the concave surface 7.

The addition of the plurality of spray nozzles 40 enables the present invention to operate with options of self-mechanical clean, water-clean, or a combination thereof. The combinations include waterless mode, trace water mode, and flushing mode (i.e., applying minimum amount of water needed to flush all the collected excrement out of the receiving trough 1 without activation of the removal scraper 8). For example, in a waterless mode, the present invention can operate without engaging the plurality of spray nozzles 40. Further, in a trace water mode, the plurality of spray nozzles 40 is engaged, and only small quantities of water and/or chemicals are used to assist in the waste cleaning process to achieve the desired sanitary requirements. Furthermore, in a flushing mode, the removal scraper 8 is kept inactive or removed and the plurality of spray nozzles 40 are engaged. The plurality of spray nozzles 40 utilizes greater quantities of water in this mode to have enough pressure to splash out the excrement. Both the trace water mode and the flushing mode can achieve the same levels of sanitary conditions as traditional flushing toilets, but significant less water is required compared with traditional flushing toilets.

As can be seen in FIGS. 1 through 5, the present invention also comprises a rear enclosure 48 that encloses all the parts around the rear of the toilet. The rear enclosure 48 is externally integrated onto the receiving trough 1, adjacent to the open end 3, to seal the connection area between the open end 3 and opening of septic tank or sewer system to prevent the toxic fumes escape from the excrement storage compartment or the sewer system/tank into user area. In some embodiments, the rear enclosure 48 may also house a removable waste receptacle and/or a water/detergent reservoir in case the present invention is designed as a portable toilet. The present invention may also include a power source, such as a battery, to power up the electrical components as well as a water/detergent reservoir for the plurality of spray nozzles 40. As previously discussed, the present invention can be configured to be used in a commercial or residential facility. If so, the open end 3 may be connected to the plumbing system of the facility so that the excrement is disposed into the existing sewer system. In some embodiments, the open end 3 may protrude outside bathroom and/or building so that the excrement can be disposed into an external removable waste receptacle or septic tank for decomposition directly to avoid handling the excrement inside bathroom or building. The present invention may also be connected to the water utilities of the facility to provide the water necessary for the plurality of spray nozzles 40, but the present invention may also include a water/detergent reservoir for the plurality of spray nozzles 40 if water supply is not available. In addition, the present invention can be wired to the electrical utilities of the facility to power up the electrical components of the present invention.

The present invention also provides means to manage the toxic fumes that originate from the plumbing system or waste storage compartment within the rear enclosure 48 and particularly the collected excrement within the receiving trough 1. As can be seen in FIGS. 1 through 5, to do so, the present invention may further comprise a ventilation system 49. The ventilation system 49 is preferably a motorized system that operates automatically to manage the toxic fumes. The ventilation system 49 comprises at least one ventilation inlet 50 and at least one ventilation outlet 51 to outside building or toilet room to enable the outflow of toxic fumes from the rear enclosure 48. The at least one ventilation outlet 51 is positioned offset from the receiving trough 1 to enable the outflow of the toxic fumes into the rear enclosure 48 and then ventilation outlet 51 through the open end 3 with the second translation mechanism 29 engaged to move the back door 25 to expose the open end 3 while the present invention is in use. This way, the present invention features very efficient ventilation means to eliminate toxic fumes from user by venting the toxic fumes from the excrement collected within the receiving trough 1 instantly through nearby the open end 3. As such, the present invention also prevents the toxic fumes from escaping into the surroundings and minimizes amount of room temperature air needs to be vented out to keep bathroom odor free. As a result, the present invention can help to save room air control energy significantly, especially during cool winter and hot summer. Further, the controller 36 is electronically connected to the ventilation system 49 to enable the automatic operation of the ventilation system 49.

To increase the conformity for users while using the present invention, the present invention further comprises a toilet seat 46 and a seat cover 47, as can be seen in FIGS. 1 through 5, like in traditional toilets. Also like in traditional toilets, the seat cover 47 seals the lateral opening 4 while the present invention is not in use. To do so, the toilet seat 46 is positioned adjacent to the lateral opening 4. The toilet seat 46 is also hingedly connected to the open end 3 so that the toilet seat 46 can be lifted if the user does not want to use the toilet seat 46. Further, the seat cover 47 is also hingedly connected to the toilet seat 46, adjacent to the open end 3, so that the lateral opening 4 can be selectively exposed by the user.

All the automatic features of the present invention can be automatically engaged by the controller 36 as programmed according to specified requirements for a given embodiment, with options for user to start and/or terminate by press a start/stop button. As can be seen in FIGS. 1 through 4 and 40, to do so, the present invention may further comprise a starter switch 45 and one or more sensors under the toilet seat 46 in some embodiments. The starter switch 45 is preferably touchless and equipped with one or more sensors to automatically detect when the user is started and when the user is finished using the present invention. The one or more sensors can be proximity sensors or motion sensors that monitor the positioning and/or the movement of the user. To do so, the starter switch 45 is mounted onto the receiving trough 1 to monitor the movement of the user. The controller 36 is electronically connected to the starter switch 45 and to receive an engage signal. In one embodiment, once the user is started using the present invention, one or more sensors under the toilet seat 46 transmit the engage signal to the controller 36 which then engages the ventilation system 49 and the second translation mechanism 29 to move the back door 25 away to the side to expose the open end 3 so the toxic fumes from the excrement collected within the receiving through 1 are vented away instantly through the open end 3 at the bottom behind the user. (In case user chose to keep the back door 25 close while using the present invention, user can also press the starter switch 45 to transmits the engage signal to the controller 36 which then engages the second translation mechanism 29 to move the back door 25 to expose the open end 3 after finished using the present invention, then any excrement attached on the back door 25 is mechanically cleaned by the rear edge of the receiving trough 1 first during the movement against the open end 3).

When the user has left and/or done using the present invention, the at least one first spray nozzle 41 is then engaged to spray fluids onto the scrubber 39 as needed, and the first translation mechanism 26 is engaged to move the removal scraper 8 to the open end 3. As the removal scraper 8 is moved along the receiving trough 1, the rearward face 11 pushes the collected excrement along until the collected excrement is pushed out through the open end 3. Once the removal scraper 8 reaches the open end 3 and the collected excrement has been removed, the at least one second spray nozzle 42 is then engaged to splash the rearward face 11. The hydrophobic coating 37 helps with removing any excrement residue on the rearward face 11. After the at least one second spray nozzle 42 is disengaged, the second translation mechanism 29 is engaged to move the back door 25. The scrubber 39 wipes the rearward face 11 to ensure that the removal scraper 8 is clean. The second translation mechanism 29 can be reengaged to seal or open the open end 3 again as needed. Then, the first translation mechanism 26 is engaged to pull the removal scraper 8 through the hook 23 and the springboard 20, making the removal scraper 8 pivot upwards while moving toward the closed end 2. As soon as the removal scraper 8 reaches the position where a second board end 22 of the springboard 20 touches the scrapper stopper 52 mounted nearby the starter position adjacent to the close end 2, the at least one third spray nozzle 43 is engaged to dispense fluids to ensure that the receiving trough 1 and the convex edge 12 are clean. The first translation mechanism 26 can be reengaged multiple times to scrape the concave surface 7 until the concave surface 7 is clean. Then, the removal scraper 8 is repositioned to the starting position and fall with the convex edge 12 in close contact with the concave surface 7 for the next use with help of the scrapper stopper 52 to provide upward force on the springboard 20 that make the scraper plate 9 pivoted down.

As mentioned previously, all the automatic features of the present invention can be automatically engaged by the controller 36 as programmed according to specified requirements for all embodiments, with options for user to start and/or terminate by press a start/stop button. In addition, for some embodiments, manual operation can also be utilized by proper arranged gear cables, gears, and springs that can motivate and control the movements of the removal scraper 8 and the back door 25 to accomplish excrement remove and clean process. In some embodiments, the present invention may utilize non-mechanical means to manage the toxic fumes from the backend enclosure 48, such as chemicals.

Although the invention has been explained in relation to its preferred embodiment, it is to be understood that many other possible modifications and variations can be made without departing from the spirit and scope of the invention.

What is claimed is:

1. A self-mechanical-cleaning toilet system with water-splash cleaning options comprising:
- a receiving trough;
- a removal scraper;
- a guide bar;
- a back door;
- a first translation mechanism;
- a second translation mechanism;
- a controller;
- the receiving trough comprising a closed end, an open end, a lateral opening, a first lengthwise edge, and a second lengthwise edge;
- the first lengthwise edge and the second lengthwise edge being positioned parallel and offset from each other;
- the lateral opening being delineated by the first lengthwise edge, the second lengthwise edge, the closed end, and the open end;
- the removal scraper being slidably mounted into the receiving trough through the lateral opening;
- the guide bar being positioned perpendicular and across the lateral opening;
- the guide bar being operatively coupled to the receiving trough by the first translation mechanism, wherein the first translation mechanism is used to move the guide bar along the receiving trough;
- the guide bar being operatively coupled to the removal scraper, wherein the guide bar is used to push and pull the removal scraper along the receiving trough;
- the back door being slidably mounted across the open end;
- the second translation mechanism the back door being operatively mounted to the back door and the open end, wherein the second translation mechanism is used to move the back door across the open end and is used to retract the back door from the open end; and
- the controller being electronically connected to the first translation mechanism and the second translation mechanism.

2. The self-mechanical-cleaning toilet system with water-splash cleaning options as claimed as in claim 1 comprising:
- the removal scraper comprising a scraper plate, a scraper bracket, a first pin, and a second pin;
- the scraper plate comprising a forward face and a rearward face;
- the forward face being oriented towards the closed end;
- the rearward face being oriented towards the open end;
- the scraper bracket being connected onto the forward face;
- the first pin being slidably and rotatably connected along the first lengthwise edge;
- the second pin being slidably and rotatably connected along the second lengthwise edge;
- the scraper bracket being connected in between the first pin and the second pin; and
- the guide bar being operatively coupled in between the scraper plate and the scraper bracket, wherein the guide bar is used to slide the scraper plate towards the open end and is used to slide the scraper plate towards the closed end.

3. The self-mechanical-cleaning toilet system with water-splash cleaning options as claimed as in claim 2 comprising:
- a hydrophobic coating; and
- the hydrophobic coating being superimposed across the rearward face.

4. The self-mechanical-cleaning toilet system with water-splash cleaning options as claimed as in claim 2 comprising:
- the removal scraper further comprising a first bumper and a second bumper;
- the first bumper and the second bumper being peripherally connected onto the forward face;
- the first bumper and the second bumper being positioned offset from the scraper bracket; and
- the first bumper and the second bumper being positioned offset to each other.

5. The self-mechanical-cleaning toilet system with water-splash cleaning options as claimed as in claim 4 comprising:
- wherein the guide bar, the first bumper, and the second bumper are arranged into a waste removal configuration; and
- the guide bar being positioned against the first bumper and the second bumper.

6. The self-mechanical-cleaning toilet system with water-splash cleaning options as claimed as in claim 2 comprising:
- the scraper plate comprising a convex edge;
- the receiving trough further comprising a concave surface; and
- the convex edge being coextensive with the concave surface.

7. The self-mechanical-cleaning toilet system with water-splash cleaning options as claimed as in claim 6 comprising:
- a rubber lining; and
- the rubber lining being connected along the convex edge.

8. The self-mechanical-cleaning toilet system with water-splash cleaning options as claimed as in claim 2 comprising:
- the removal scraper further comprising a first catcher and a second catcher;
- the first catcher and the second catcher each comprising a springboard and a hook;
- the springboard comprising a first board end and a second board end;
- the first catcher and the second catcher being positioned adjacent to the scraper bracket, opposite the scraper plate;
- the first catcher and the second catcher being positioned offset from each other;
- the first board end of the first catcher and the first board end of the second catcher being connected onto the scraper bracket;
- the hook being connected onto the second board end; and
- the springboard being oriented away from the receiving trough.

9. The self-mechanical-cleaning toilet system with water-splash cleaning options as claimed as in claim 8 comprising:
- wherein the guide bar, the first catcher, and the second catcher are arranged into a retraction configuration; and
- the guide bar being positioned against the hook of the first catcher and the hook of the second catcher.

10. The self-mechanical-cleaning toilet system with water-splash cleaning options as claimed as in claim 1 comprising:
- the first translation mechanism comprising a first motorized carriage and a second motorized carriage;
- the first motorized carriage being movably mounted along the first elongated guide;
- the second motorized carriage being movably mounted along the second elongated guide;

the first motorized carriage being terminally connected to the guide bar; and the second motorized carriage being terminally connected to the guide bar, opposite to the first motorized carriage.

11. The self-mechanical-cleaning toilet system with water-splash cleaning options as claimed in claim 1 comprising:

the second translation mechanism comprising a first pulley, a second pulley, and a translation cable;

the translation cable comprising a first cable end and a second cable end;

the first pulley being a motorized pulley;

the first pulley being positioned offset from the back door;

the second pulley being positioned offset from the back door, opposite the first pulley;

the first pulley and the second pulley being rotatably mounted to the open end;

the translation cable being frictionally engaged about the first pulley and about the second pulley;

the first cable end being connected adjacent to the back door; and the second cable end being connected adjacent to the back door, opposite to the first cable end.

12. The self-mechanical-cleaning toilet system with water-splash cleaning options as claimed in claim 1 comprising:

a scrubber;

the scrubber being positioned in between the back door and the open end; and the scrubber being connected across the back door.

13. The self-mechanical-cleaning toilet system with water-splash cleaning options as claimed in claim 1 comprising:

a plurality of spray nozzles;

a water inlet;

the water inlet being in fluid communication with each of the plurality of spray nozzles;

the plurality of spray nozzles being operatively mounted to the receiving trough, wherein the plurality of spray nozzles is used to dispense water onto the back door and a concave surface of the receiving trough; and the controller being electronically connected to the plurality of spray nozzles.

14. The self-mechanical-cleaning toilet system with water-splash cleaning options as claimed in claim 13 comprising:

the plurality of spray nozzles comprising at least one first spray nozzle;

the at least one first spray nozzle being laterally positioned to the receiving trough;

the at least one first spray nozzle being mounted adjacent to the open end; and the at least one first spray nozzle being oriented away from the closed end.

15. The self-mechanical-cleaning toilet system with water-splash cleaning options as claimed in claim 13 comprising:

the plurality of spray nozzles comprising at least one second spray nozzle;

the at least one second spray nozzle being positioned adjacent to the lateral opening;

the at least one second spray nozzle being mounted adjacent to the open end; and the at least one second spray nozzle being oriented towards the open end.

16. The self-mechanical-cleaning toilet system with water-splash cleaning options as claimed in claim 13 comprising:

the plurality of spray nozzles comprising at least one third spray nozzle;

the at least one third spray nozzle being positioned within the receiving trough;

the at least one third spray nozzle being mounted adjacent to the closed end; and the at least one third spray nozzle being oriented towards the open end.

17. The self-mechanical-cleaning toilet system with water-splash cleaning options as claimed in claim 1 comprising:

a starter switch;

the starter switch being mounted onto the receiving trough; and the controller being electronically connected to the starter switch.

18. The self-mechanical-cleaning toilet system with water-splash cleaning options as claimed in claim 1 comprising:

a toilet seat;

a seat cover;

the toilet seat being positioned adjacent to the lateral opening;

the toilet seat being hingedly connected to the open end; and the seat cover being hingedly connected to the toilet seat, adjacent to the open end.

19. The self-mechanical-cleaning toilet system with water-splash cleaning options as claimed in claim 1 comprising:

a rear enclosure;

the rear enclosure being externally mounted to the receiving trough, adjacent to the open end; and the open end being in fluid communication with the rear enclosure.

20. The self-mechanical-cleaning toilet system with water-splash cleaning options as claimed in claim 19 comprising:

a ventilation system;

the ventilation system comprising at least one ventilation inlet and at least one ventilation outlet;

the rear enclosure being in fluid communication with the at least one ventilation inlet;

the at least one ventilation outlet being positioned offset from the receiving trough; and the controller being electronically connected to the ventilation system.

* * * * *